US010233044B2

(12) United States Patent
Yamaguchi

(10) Patent No.: US 10,233,044 B2
(45) Date of Patent: Mar. 19, 2019

(54) CONVEYING APPARATUS, SHEET CONVEYING APPARATUS AND IMAGE RECORDING APPARATUS

(71) Applicant: BROTHER KOGYO KABUSHIKI KAISHA, Nagoya-shi, Aichi-ken (JP)

(72) Inventor: Masatomo Yamaguchi, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/833,622

(22) Filed: Dec. 6, 2017

(65) Prior Publication Data

US 2018/0095400 A1 Apr. 5, 2018

Related U.S. Application Data

(62) Division of application No. 15/331,178, filed on Oct. 21, 2016, now Pat. No. 9,851,676.

(30) Foreign Application Priority Data

Oct. 23, 2015 (JP) ..... 2015-209302
Jan. 29, 2016 (JP) ..... 2016-016734

(51) Int. Cl.
*B65H 5/36* (2006.01)
*G03G 15/00* (2006.01)
(Continued)

(52) U.S. Cl.
CPC ..... *B65H 5/36* (2013.01); *B41J 2/01* (2013.01); *B65H 1/04* (2013.01); *B65H 1/266* (2013.01);
(Continued)

(58) Field of Classification Search
CPC . B65H 5/00; B65H 5/06; B65H 5/062; B65H 5/068; B65H 5/26; B65H 5/36;
(Continued)

(56) References Cited

U.S. PATENT DOCUMENTS 5,052,670 A * 10/1991 Makiura ..... G03G 15/234 271/127
RE44,946 E * 6/2014 Shiohara ..... B65H 5/26 271/9.11
(Continued)

FOREIGN PATENT DOCUMENTS

JP 8-157107 A 6/1996
JP 2009-179447 A 8/2009

*Primary Examiner* — Prasad V Gokhale
(74) *Attorney, Agent, or Firm* — Merchant & Gould P.C.

(57) ABSTRACT

A conveying apparatus includes: a casing formed with a first sheet-conveyance passage and a second sheet-conveyance passage positioned inwardly as compared with the first sheet-conveyance passage; a cover member including a first resin member having a first guide surface for defining the first sheet-conveyance passage, a second resin member attached to the first resin member and located on an inner side of the casing than the first guide surface and defining the first sheet-conveyance passage, and a third resin member attached to the second resin member at a position opposite to the first resin member with respect to the second resin member and having a third guide surface for defining the second sheet-conveyance passage; and a metal frame attached to the second resin member at a position between the second resin member and the third resin member.

13 Claims, 10 Drawing Sheets

(51) Int. Cl.

| | |
|---|---|
| ***B65H 1/04*** | (2006.01) |
| ***B65H 1/26*** | (2006.01) |
| ***B65H 5/26*** | (2006.01) |
| ***B65H 5/38*** | (2006.01) |
| ***B65H 85/00*** | (2006.01) |
| ***B41J 2/01*** | (2006.01) |
| ***G03G 21/16*** | (2006.01) |

(52) U.S. Cl.
CPC ..... *B65H 5/26* (2013.01); *B65H 5/38* (2013.01); *B65H 85/00* (2013.01); *G03G 15/6529* (2013.01); *G03G 21/1633* (2013.01); *B65H 2301/333* (2013.01); *B65H 2401/115* (2013.01); *B65H 2401/15* (2013.01); *B65H 2402/31* (2013.01); *B65H 2402/441* (2013.01); *B65H 2402/45* (2013.01); *B65H 2404/531* (2013.01); *B65H 2404/56* (2013.01); *B65H 2405/10* (2013.01); *B65H 2801/06* (2013.01); *G03G 2215/00544* (2013.01)

(58) Field of Classification Search
CPC .... B65H 5/38; B65H 85/00; B65H 2301/333; B65H 2401/115; B65H 2401/15; B65H 2402/31; B65H 2402/45; B65H 2402/441; B65H 2404/531; B65H 2404/56; G03G 21/1633; G03G 2215/00544
See application file for complete search history.

(56) References Cited

U.S. PATENT DOCUMENTS

| | | | | |
|---|---|---|---|---|
| 9,637,335 | B2 * | 5/2017 | Ono | B65H 5/36 |
| 2009/0194931 | A1 * | 8/2009 | Shiohara | B65H 5/26 271/8.1 |
| 2010/0189485 | A1 * | 7/2010 | Ichikawa | B65H 5/062 399/388 |
| 2010/0329737 | A1 * | 12/2010 | Koga | G03G 15/6529 399/124 |
| 2011/0001284 | A1 * | 1/2011 | Ohtsuki | B65H 5/26 271/162 |
| 2013/0071166 | A1 * | 3/2013 | Mori | G03G 15/6573 399/364 |
| 2013/0249161 | A1 * | 9/2013 | Uchino | B65H 3/0684 271/9.01 |
| 2016/0083215 | A1 * | 3/2016 | Furuta | B65H 37/00 271/208 |

* cited by examiner

CONVEYING APPARATUS, SHEET CONVEYING APPARATUS AND IMAGE RECORDING APPARATUS

CROSS REFERENCE T2016-O RELATED APPLICATION

This application is a divisional of U.S. patent application Ser. No. 15/331,178 filed on Oct. 21, 2016 and further claims priorities from Japanese Patent Applications No. 2015-209302 filed on Oct. 23, 2015 and No. 2016-016734 filed on Jan. 29, 2016, the disclosures of which are incorporated herein by reference in their entireties.

BACKGROUND

Field of the Invention

The present invention relates to a conveying apparatus which conveys a sheet along a conveyance passage, and an image recording apparatus which is provided with the conveying apparatus and which records an image on the sheet.

Description of the Related Art

A conveying apparatus is known, in which the sheet is conveyed along a conveyance passage formed at the inside. Image recording apparatuses, which include, for example, printers and multifunction peripherals, are known as the apparatus provided with the conveying apparatus as described above. Further, some of the conveying apparatuses and the image recording apparatuses have a plurality of conveyance passages which are formed at the inside. For example, an image recording apparatus is known, in which sheets are fed from a plurality of feed trays to different conveyance passages respectively. Further, an image recording apparatus is known, which has a conveyance passage for reversing or inverting the sheet having an image recorded on a surface, in order to record images on both surfaces of the sheet.

In many cases, the conveying apparatus and the image recording apparatus are constructed such that a part of the conveyance passage is exposed to the outside when the conveyance passage is jammed with the sheet. Accordingly, the sheet, with which the conveyance passage is jammed, can be taken out. For example, such an image recording apparatus is known that a cover, which defines a first conveyance passage, is pivotally attached to a main body, and a guide member, which defines the first conveyance passage at an inner position of the main body as compared with the cover and which defines a second conveyance passage, is pivotally attached to the main body. In the case of the image recording apparatus as described above, the first conveyance passage and the second conveyance passage can be exposed to the outside by moving the cover and the guide member pivotally.

Further, such a sheet conveying apparatus is known that a conveyance passage, which has a curved portion, is provided at the inside. The sheet conveying apparatus as described above has a guide member which is provided at an outer position in relation to the curved portion of the conveyance passage. The guide member is urged by a compression coil spring while being directed toward an inner position of the curved portion. In the case of this arrangement, when the forward end of the sheet is allowed to abut by a resist roller, then the sheet is in a curved state, and the sheet abuts against the guide member. Accordingly, the urging force of the compression coil spring is applied to the sheet by the aid of the guide member. The forward end of the sheet is pressed against the resist roller, and the oblique travel state of the sheet is dissolved.

SUMMARY

However, in the case of the image recording apparatus as described above, the cover and the guide member are pivotally moved individually with respect to the main body. On this account, any noise appears in some cases on account of the backlash of the guide member. Further, if the guide member is constructed to be moved pivotally with respect to the main body, the position of the guide member, especially the position of the forward end of the pivotal movement of the guide member becomes unstable in some cases. As a result, the first conveyance passage or the second conveyance passage is jammed with the sheet guided by the guide member in some cases.

In the case of the sheet conveying apparatus as described above, a cover member is urged by a plurality of compression coil springs which are arranged while providing spacing distances in a widthwise direction orthogonal to a conveyance direction of the sheet. On this account, a space is required to provide the compression coil springs on a side opposite to the conveyance passage with respect to the cover member. Therefore, the apparatus is large-sized.

Further, in the case of the arrangement of the sheet conveying apparatus described above, the pressing force, which is allowed to act on the sheet by the cover member, is dispersed in the widthwise direction in some cases. That is, the cover member strongly presses the sheet at portions at which the compression coil springs are arranged. However, the pressing force, which is exerted on the sheet, is weakened at portions at which the compression coil springs are not arranged. On this account, the force, by which the forward end of the sheet is pressed against the resist roller, is dispersed. The oblique travel state of the sheet is not dissolved reliably in some cases.

The present teaching has been made taking the foregoing problems into consideration, an object of which is to provide means which makes it possible to reduce the backlash of the guide member for guiding the sheet and stabilize the position of the guide member. Further, another object is to provide a sheet conveying apparatus which is small-sized and which makes it possible to reliably dissolve the oblique travel state of the sheet.

According to a first aspect of the present teaching, there is provided a conveying apparatus including:

a casing formed with a first sheet-conveyance passage extending in a first conveyance direction and a second sheet-conveyance passage formed inwardly as compared with the first sheet-conveyance passage and extending in a second conveyance direction;

a cover member including: a first resin member having a first guide surface which defines the first sheet-conveyance passage; a second resin member attached to the first resin member and having a second guide surface which is located on an inner side of the casing than the first guide surface to face the first guide surface and defines the first sheet-conveyance passage together with the first guide surface; and a third resin member attached to the second resin member at a position opposite to the first resin member with respect to the second resin member and having a third guide surface which defines the second sheet-conveyance passage, the cover member being movable to a first position at which the cover closes the first sheet-conveyance passage and the second sheet-conveyance passage with respect to outside of the casing and a second position at which the cover opens the first sheet-conveyance passage and the second sheet-conveyance passage to the outside of the casing; and a metal frame attached to the second resin member at a position between the second resin member and the third resin member, wherein the first sheet-conveyance passage is connected to the second sheet-conveyance passage at a position downstream of the first resin member and the second resin member in the first conveyance direction, the third resin member has a coefficient of friction smaller than that of the second resin member, and a downstream end portion of the third resin member in the second conveyance direction extends to a position downstream of the first resin member and the second resin member in the first conveyance direction, and has a fourth guide surface which defines the first sheet-conveyance passage.

According to this arrangement, the second resin member is attached to the first resin member, and the third resin member is attached to the second resin member. Therefore, the backlashes of the second resin member and the third resin member are reduced as compared with a case in which the second resin member and the third resin member are pivotally attached to the casing. Accordingly, it is possible to reduce the appearance of noise which would be otherwise caused by the backlashes of the second resin member and the third resin member. Further, accordingly, it is possible to stabilize the positions of the second resin member and the third resin member.

Further, according to this arrangement, the third resin member extends to the position downstream in the first conveyance direction as compared with the first resin member and the second resin member. Therefore, the sheet, which is guided by the guide member along the first sheet-conveyance passage and the second sheet-conveyance passage, is finally guided by the third resin member along the first sheet-conveyance passage and the second sheet-conveyance passage. In this arrangement, the member, which has the small coefficient of friction, is used for the third resin member. On this account, it is possible to smoothly feed the sheet from the guide member to the downstream of the first sheet-conveyance passage. In this context, if the position of the third resin member is not stabilized, the position of the sheet fed to the downstream of the first sheet-conveyance passage from the guide member is not stabilized. In view of the above, in this arrangement, the metal frame is attached to the second resin member. Accordingly, the warpage or the like of the second resin member is reduced, and hence it is possible to stabilize the shape of the second resin member. As a result, it is possible to stabilize the positions of the second resin member and the third resin member attached to the second resin member.

According to a second aspect of the present teaching, there is provided a sheet conveying apparatus including:

a casing formed with a conveyance passage including a curved passage; a conveyance roller positioned downstream of the curved passage in a conveyance direction of a sheet and configured to convey the sheet;

a resin member positioned outwardly in relation to the curved passage, having both end portions in a widthwise direction orthogonal to the conveyance direction which are supported by the casing, and having a central portion in the widthwise direction which is elastically deformable to be warped outwardly in relation to the curved passage;

a metal frame attached to the resin member such that a relative position in the widthwise direction with respect to the resin member is displaceable; and another resin member provided closely to the curved passage as compared with the metal frame, attached to the resin member to constitute an outer guide surface for comparing at least a part of the curved passage, and having a coefficient of friction smaller than that of the resin member at least on the outer guide surface.

According to this arrangement, when the sheet, which is conveyed along the conveyance passage, arrives at the conveyance roller, the sheet is in the curved state at the curved passage of the conveyance passage. When the curved portion of the sheet abuts against the first guide surface of the another resin member, the force, which is directed outwardly in relation to the curved passage in the conveyance passage, acts on the another resin member. In accordance with this force, the force is also applied in the same direction to the resin member to which the another resin member is attached. Accordingly, the resin member, which has the both end portions in the widthwise direction supported by the casing, is relatively displaced in the widthwise direction with respect to the metal frame, and the resin member is elastically deformed to provide the state in which the central portion in the widthwise direction is warped outwardly.

In this case, the force, which is directed inwardly in relation to the curved passage, appears over the entire portion in the widthwise direction owing to the elastic restoring force of the resin member. Accordingly, the pressing force uniformly acts on the sheet over the entire portion in the widthwise direction. As a result, the entire forward end of the sheet abuts against the conveyance roller, and the oblique travel of the sheet is dissolved.

As described above, the sheet, which is conveyed along the conveyance passage, can be pressed by the elastic restoring force of the resin member. Therefore, it is unnecessary to provide any member which generates the urging force on the side of the resin member opposite to the conveyance passage. Therefore, it is unnecessary to secure any space on the side of the resin member opposite to the conveyance passage. It is possible to miniaturize the entire sheet conveying apparatus.

DESCRIPTION OF THE EMBODIMENTS

Figure 1:
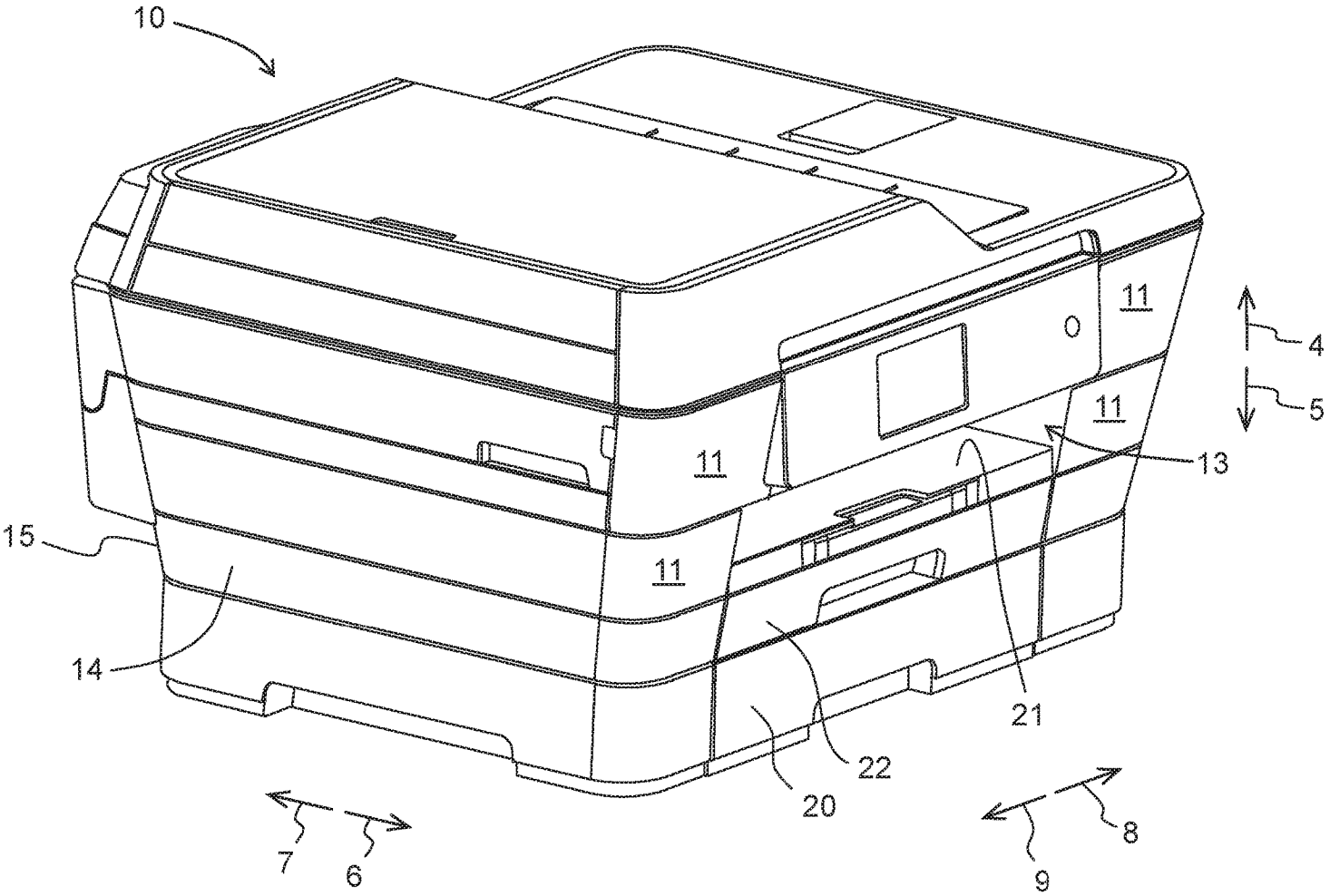
FIG. 1 depicts a perspective view illustrating a multifunction peripheral.

An embodiment of the present teaching will be explained below. Note that it goes without saying that the embodiment explained below is merely an example of the present teaching, and the embodiment of the present teaching can be appropriately changed within a range without changing the gist or essential characteristics of the present teaching. Further, in the following explanation, the upward direction 4 and the downward direction 5 are defined on the basis of a state (state depicted in FIG. 1) in which the multifunction peripheral 10 is installed usably, the frontward direction 6 and the backward direction 7 are defined assuming that the surface provided with an opening 13 is a front surface 11, and the rightward direction 8 and the leftward direction 9 are defined while viewing the multifunction peripheral 10 in the backward direction 7. The upward direction 4 and the downward direction 5 are mutually opposite directions. The frontward direction 6 and the backward direction 7 are mutually opposite directions. The rightward direction 8 and the leftward direction 9 are mutually opposite directions. The upward direction 4, the frontward direction 6, and the rightward direction 8 are orthogonal to one another. Further, in the following explanation, the left-right direction is also referred to as "widthwise direction".

<Overall Structure of Multifunction Peripheral 10>

As depicted in FIG. 1, the multifunction peripheral 10 (example of the image recording apparatus) is formed to have a generally rectangular parallelepiped shape. The multifunction peripheral 10 has various functions including, for example, the facsimile function and the printing function. As for the printing function, the multifunction peripheral 10 has a function to record an image or images on one surface or both surfaces of the recording paper 12 (example of the sheet, see FIG. 2).

Figure 2:
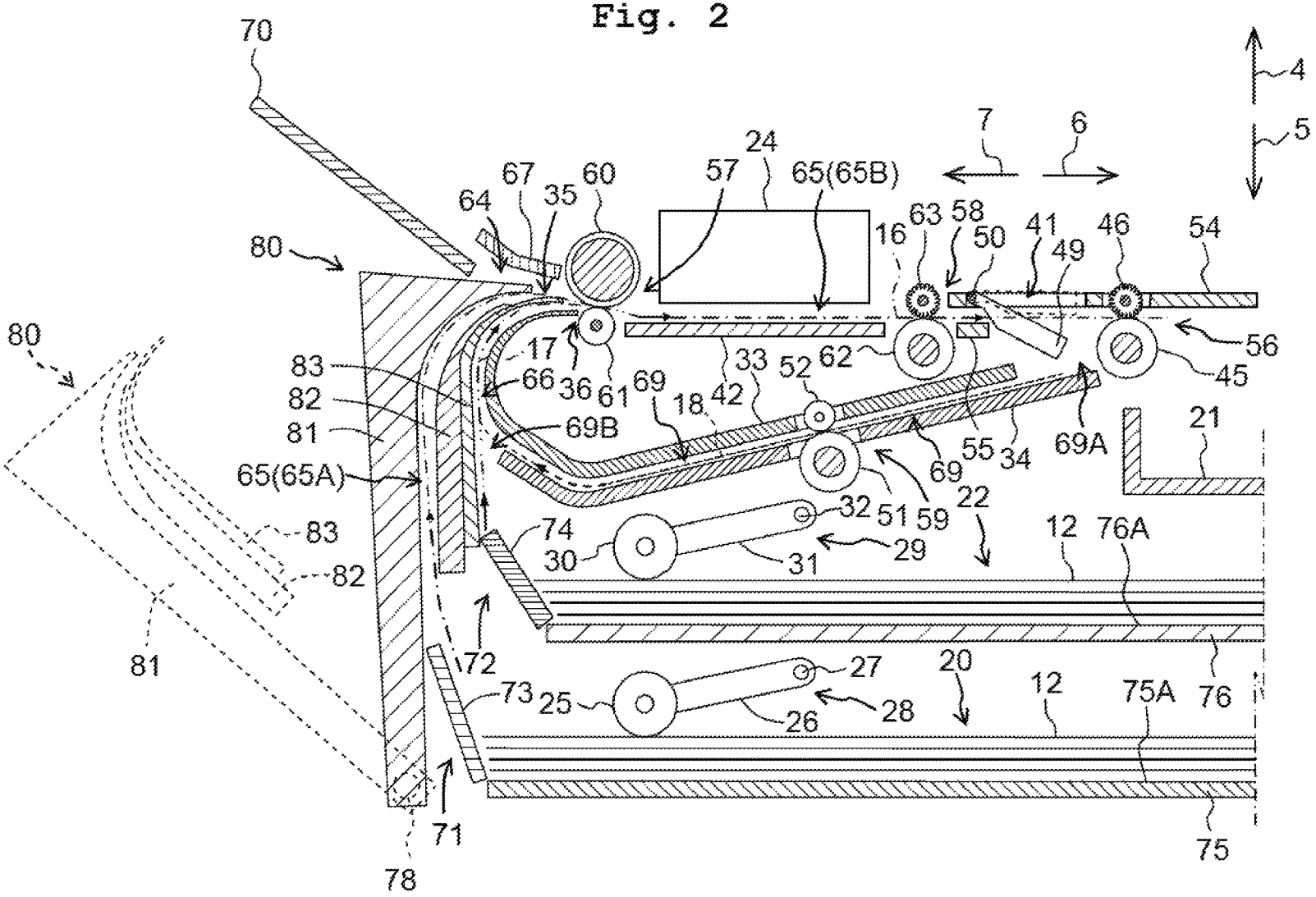
FIG. 2 depicts a vertical sectional view schematically illustrating the interior of the multifunction peripheral.

As depicted in FIG. 2, the multifunction peripheral 10 is provided with a conveying apparatus, a recording unit 24, and a platen 42. The conveying apparatus includes a casing 14, a conveyance roller pair 57 (example of the roller pair), a discharge roller pair 58, a first feed tray 20, a second feed tray 22, a rear tray 70 (example of the sheet tray), a discharge tray 21, a first feed unit 28, a second feed unit 29, a first guide member 71, a second guide member 72 (example of the guide member), a cover member 80, and a metal frame 84 (see FIG. 3).

As depicted in FIG. 1, the casing 14 constitutes the appearance of the multifunction peripheral 10. An opening 13 is formed on a front surface 11 of the casing 14. As depicted in FIG. 2, the conveyance roller pair 57, the discharge roller pair 58, the first feed unit 28, the second feed unit 29, the first guide member 71, and the second guide member 72 are arranged at the inside of the casing 14. A first conveyance passage 65 (first sheet-conveyance passage), a second conveyance passage 66 (second sheet-conveyance passage), a third conveyance passage 64 (third sheet-conveyance passage), and a fourth conveyance passage 69 (fourth sheet-conveyance passage), along which the recording paper 12 is conveyed, are formed at the inside of the casing 14. The first feed tray 20 and the second feed tray 22 are installed to the casing 14 by being inserted in the backward direction 7 via the opening 13 into the casing 14. The first feed tray 20 and the second feed tray 22 are removed in the frontward direction 6 via the opening 13 from the casing 14. The discharge tray 21 is supported by the second feed tray 22, and the discharge tray 21 is movable integrally with the second feed tray 22. Note that the discharge tray 21 may be arranged for the casing 14 independently from the second feed tray 22. The rear tray 70 and the cover member 80 are supported by the casing 14. The metal frame 84 is attached to the cover member 80.

As depicted in FIGS. 1 and 2, the second feed tray 22 is arranged under or below the recording unit 24 in a state of being installed to the casing 14. The first feed tray 20 is arranged under or below the second feed tray 22 installed to the casing 14 in a state of being installed to the casing 14. As depicted in FIG. 2, the recording paper 12, which is supported by the first feed tray 20, can be fed to the first conveyance passage 65 in a state in which the first feed tray 20 is installed to the casing 14. The recording paper 12, which is supported by the second feed tray 22, can be fed to the second conveyance passage 66 in a state in which the second feed tray 22 is installed to the casing 14.

Each of the feed trays 20, 22 is formed to have a generally rectangular parallelepiped box shape which is open upwardly. The first feed tray 20 is provided with a bottom plate 75 on which a plurality of sheets of the recording paper 12 are supported in a stacked state. The second feed tray 22 is provided with a bottom plate 76 on which a plurality of sheets of the recording paper 12 is supported in a stacked state. The discharge tray 21 is supported at an upper front position over the second feed tray 22.

The recording paper 12, which is supported by the bottom plate 75, is fed to the first conveyance passage 65 by being fed in the backward direction 7 by means of the first feed unit 28, and the recording paper 12 is conveyed in the conveyance direction 16 indicated by an alternate long and short dash line depicted in FIG. 2 (example of the first conveyance direction) along the first conveyance passage 65. When the downstream end in the conveyance direction 16 of the recording paper 12 conveyed along the first conveyance passage 65 arrives at the conveyance roller pair 57, the recording paper 12 is conveyed in the conveyance direction 16 toward the recording unit 24 along the first conveyance passage 65 by means of the conveyance roller pair 57. The recording paper 12, which arrives at the position disposed just under the recording unit 24, is subjected to the image recording by the recording unit 24.

The recording paper 12, which is placed on the bottom plate 76, is fed to the second conveyance passage 66 by being fed in the backward direction 7 by means of the second feed unit 29. The recording paper 12 is conveyed in the conveyance direction 17 indicated by an alternate long and two short dashes line depicted in FIG. 2 (example of the second conveyance direction) along the second conveyance passage 66. The downstream end in the conveyance direction 17 of the second conveyance passage 66 merges with the first conveyance passage 65 at the merging position 36 (example of the connecting position). In this case, the merging position 36 is the position which is disposed upstream in the conveyance direction 16 from the conveyance roller pair 57 and which is disposed downstream in the conveyance direction 16 from the cover member 80. The recording paper 12, which is conveyed to the first conveyance passage 65 via the merging position 36, is conveyed toward the recording unit 24 along the first conveyance passage 65 in the same manner as the recording paper 12 supported by the bottom plate 75.

<First Feed Unit 28 and Second Feed Unit 29>

As depicted in FIG. 2, the first feed unit 28 is provided over the first feed tray 20 which is in the state of being installed to the casing 14. The first feed unit 28 is provided with a first feed roller 25, a first arm 26, and a first shaft portion 27.

The first feed roller 25 is rotatably supported by the forward end portion of the first arm 26. The first arm 26 is pivotally supported by the first shaft portion 27 supported by the casing 14. The first arm 26 extends backwardly from the portion at which the first arm 26 is supported by the first shaft portion 27. The first arm 26 is urged to pivot downwardly by its self-weight or an elastic force exerted by a spring or the like. Accordingly, the first feed roller 25 abuts against the bottom plate 75 when no recording paper 12 is supported by the bottom plate 75. Further, when the recording paper 12 is supported by the bottom plate 75, the first feed roller 25 abuts against the sheet of the recording paper 12 disposed at the uppermost position, of the sheets of the supported recording paper 12.

The first feed roller 25 is rotated by the driving force applied from a motor (not depicted). The motor may be the same as the motor for applying the driving force to a conveyance roller 60 and a discharge roller 62 described later on, or the motor may be different therefrom. The rotating first feed roller 25 picks up the recording paper 12 supported by the bottom plate 75, and the recording paper 12 is fed in the backward direction 7.

The second feed unit 29 is provided over the second feed tray 22 in the state of being installed to the casing 14. The second feed unit 29 is provided with a second feed roller 30, a second arm 31, and a second shaft portion 32. The second feed roller 30 is rotated by the driving force applied from a motor (not depicted), and thus the recording paper 12, which is supported by the bottom plate 76, is fed to the second conveyance passage 66. Note that the second feed roller 30, the second arm 31, and the second shaft portion 32 are constructed in the same manner as the first feed roller 25, the first arm 26, and the first shaft portion 27 described above respectively. Therefore, any detailed explanation thereof will be omitted.

<First Guide Member 71 and Second Guide Member 72>

As depicted in FIG. 2, the first guide member 71 and the second guide member 72 are arranged at the inside of the casing 14.

The first guide member 71 is arranged backwardly as compared with the backward end portion of the first feed tray 20 in the state of being installed to the casing 14. The first guide member 71 is provided with an inclined surface 73 which is directed in the frontward direction 6. The inclined surface 73 is inclined with respect to the upper surface 75A of the bottom plate 75. In particular, the inclined surface 73 is inclined backwardly in the upward direction 4. The lower end portion of the inclined surface 73 is disposed closely to the backward end portion of the first feed tray 20 in the state of being installed to the casing 14. The upper end portion of the inclined surface 73 is disposed closely to a first resin member 81 of the cover member 80 described later on. The recording paper 12, which is fed in the backward direction 7 by the first feed roller 25, abuts against the inclined surface 73. Accordingly, the recording paper 12 is guided along the inclined surface 73, and the recording paper 12 is fed to a curved passage 65A of the first conveyance passage 65.

The second guide member 72 is arranged backwardly as compared with the backward end portion of the second feed tray 22 in the state of being installed to the casing 14. The second guide member 72 is provided with an inclined surface 74 which is directed in the frontward direction 6. The inclined surface 74 is inclined with respect to the upper surface 76A (example of the sheet support surface) of the bottom plate 76. In particular, the inclined surface 74 is inclined backwardly in the upward direction 4. The lower end of the inclined surface 74 is disposed closely to the backward end portion of the second feed tray 22 in the state of being installed to the casing 14. The upper end of the inclined surface 74 is disposed closely to a third resin member 83 of the cover member 80 described later on. The recording paper 12, which is fed in the backward direction 7 by the second feed roller 30, abuts against the inclined surface 74. Accordingly, the recording paper 12 is guided along the inclined surface 74, and the recording paper 12 is fed to the second conveyance passage 66.

<First Conveyance Passage 65>

The first conveyance passage 65 is the route which guides the recording paper 12. As depicted in FIG. 2, the first conveyance passage 65 extends from the upper end portion of the first guide member 71 via the conveyance roller pair 57 and the recording unit 24 to the position disposed over the discharge tray 21. The first conveyance passage 65 is constructed by the curved passage 65A and a straight passage 65B.

The curved passage 65A is curved frontwardly while extending upwardly along the conveyance direction 16. The recording paper 12, which is fed in the backward direction 7 by the first feed unit 28 as starting from the state of being supported by the first feed tray 20, is guided along the inclined surface 73 of the first guide member 71, and the recording paper 12 is conveyed in the conveyance direction 16 along the curved passage 65A. Accordingly, the recording paper 12 is guided so that the recording paper 12 makes a U-turn from the downward to the upward. The recording paper 12, which has passes through the curved passage 65A, is nipped or interposed by the conveyance roller pair 57. The curved passage 65A is defined by the first resin member 81 of the cover member 80 and the second resin member 82 and the third resin member 83 of the cover member 80 described later on.

The straight passage 65B is the route which guides the recording paper 12. The straight passage 65B is continued to the downstream end in the conveyance direction 16 of the curved passage 65A, and the straight passage 65B extends to the position disposed over the discharge tray 21. The straight passage 65B extends in a straight form generally in the frontward direction 6. The recording paper 12, which arrives at the conveyance roller pair 57, is conveyed by the conveyance roller pair 57 in the frontward direction 6 along the straight passage 65B.

The straight passage 65B is defined by a first upper guide member 54 and a first lower guide member 55 at portions except for the portion at which the recording unit 24 is arranged. Further, the straight passage 65B is defined by the recording unit 24 and the platen 42 at the portion at which the recording unit 24 is arranged.

<Second Conveyance Passage 66>

The second conveyance passage 66 is the route which guides the recording paper 12. As depicted in FIG. 2, the second conveyance passage 66 is positioned in front of the curved passage 65A of the first conveyance passage 65. In other words, the second conveyance passage 66 is positioned inwardly in the casing 14 as compared with the curved passage 65A of the first conveyance passage 65. The second conveyance passage 66 extends from the upper end portion of the second guide member 72 to the merging position 36. The second conveyance passage 66 has a second curved passage 66A which is curved frontwardly while extending upwardly along the conveyance direction 17.

The recording paper 12, which is fed in the backward direction 7 by the second feed unit 29 as starting from the state of being supported by the second feed tray 22, is guided along the inclined surface 74 of the second guide member 72, and the recording paper 12 is conveyed along the conveyance direction 17 in the second curved passage 66A. Accordingly, the recording paper 12 is guided so that the recording paper 12 makes a U-turn from the downward to the upward. The recording paper 12, which has passed through the second conveyance passage 66, enters the first conveyance passage 65 from the merging position 36, and the recording paper 12 is nipped or interposed by the conveyance roller pair 57. The second conveyance passage 66 is defined by the third resin member 81 of the cover member 80 and the backward portion of the second upper guide member 33. Note that the backward portion of the second upper guide member 33 is curved in substantially the same direction as that of the third resin member 83.

<Rear Tray 70>

As depicted in FIG. 2, the rear tray 70 is supported by the casing 14 over or above the cover member 80 at the back surface 15 of the casing 14 (see FIG. 1). The rear tray 70 supports the recording paper 12. When the recording paper 12 is supported by the rear tray 70, the recording paper 12 is inserted into the casing 14 along the third conveyance passage 64 described later on. In this situation, the insertion forward end of the recording paper 12 abuts against the conveyance roller pair 57. In other words, the forward end portion of the recording paper 12 is inserted into the casing 14, and the portions other than the forward end portion are supported by the rear tray 70. When the conveyance roller 60 of the conveyance roller pair 57 is rotated in this state, the recording paper 12, which is supported by the rear tray 70, is conveyed along the first conveyance passage 65 by means of the conveyance roller pair 57. The image is recorded on the recording paper 12 by the recording unit 24, and the recording paper 12 is discharged to the discharge tray 21.

Note that it is also allowable to provide a roller which is arranged opposingly to the rear tray 70 and which abuts against the recording paper 12 supported by the rear tray 70. In this case, the recording paper 12, which is supported by the rear tray 70, is conveyed along the third conveyance passage 64 and the first conveyance passage 65 in accordance with the rotation of the roller. In this case, when the recording paper 12 is supported by the rear tray 70, it is unnecessary to insert the recording paper 12 into the casing 14.

<Third Conveyance Passage 64>

The third conveyance passage 64 is the route along which the recording paper 12 supported by the rear tray 70 is conveyed. As depicted in FIG. 2, the third conveyance passage 64 is the conveyance passage which extends toward the curved passage 65A from the rear tray 70 that is positioned backwardly and upwardly from the curved passage 65A. The third conveyance passage 64 is connected to the curved passage 65A at the merging position 35 disposed upstream in the conveyance direction from the merging position 36. The merging position 35 is positioned upstream in the conveyance direction 16 as compared with the downstream end in the conveyance direction 16 of the third resin member 83 of the cover member 80. The third conveyance passage 64 is defined by the third upper guide member 67 and the first resin member 81 of the cover member 80.

21 Fourth Conveyance Passage 69>

The fourth conveyance passage 69 is the route with which the recording paper 12 having the image recorded by the recording unit 24 is inverted upside down so that the recording paper 12 arrives at the recording unit 24 again. The fourth conveyance passage 69 of this embodiment is branched from the first conveyance passage 65 at a branching position 69A, and the fourth conveyance passage 65 merges with the second conveyance passage 66 at a merging position 69B. The branching position 69A is positioned downstream in the conveyance direction 16 from the recording unit 24. In particular, the branching position 69A is positioned between a reversing roller pair 56 and the discharge roller pair 58 of the first conveyance passage 65. The conveyance direction 18 of the recording paper 12 in the fourth conveyance passage 69 is indicated by broken line arrows in FIG. 2. The fourth conveyance passage 69 is defined by the second upper guide member 33 (in particular, a portion of the second upper guide member 33 other than the backward portion) and a second lower guide member 34 which are opposed to one another while being separated from each other by a predetermined spacing distance in the casing 14.

<Conveyance Roller Pair 57, Discharge Roller Pair 58, Reversing Roller Pair 56, and Re-conveyance Roller Pair 59>

As depicted in FIG. 2, the conveyance roller pair 57 is arranged downstream in the conveyance direction 16 from the merging position 69B in the first conveyance passage 65. The conveyance roller pair 57 is provided with a conveyance roller 60 and a pinch roller 61 which are opposed to one another. The conveyance roller 61 is rotated by the driving force transmitted from the motor (not depicted). The pinch roller 61 is rotated in accordance with the rotation of the conveyance roller 60. The conveyance roller pair 57 conveys the recording paper 12 in the conveyance direction 16 while nipping the recording paper 12.

The discharge roller pair 58 is arranged downstream in the conveyance direction 16 from the conveyance roller pair 57 in the first conveyance passage 65. The discharge roller pair 58 is provided with a discharge roller 62 and a spur 63 which are opposed to one another. The discharge roller 62 is rotated by the driving force transmitted from the motor (not depicted). The spur 63 is rotated in accordance with the rotation of the discharge roller 62. The discharge roller pair 58 conveys the recording paper 12 in the conveyance direction 16 while nipping the recording paper 12.

The reversing roller pair 56 is arranged downstream in the conveyance direction 16 from the discharge roller pair 58 in the first conveyance passage 65. The reversing roller pair 56 is provided with a reversing roller 45 and a spur 46 which are opposed to one another. The reversing roller 45 is driven by the driving force transmitted from the motor (not depicted). The spur 46 is rotated in accordance with the rotation of the reversing roller 45. The reversing roller pair 56 conveys the recording paper 12 in the conveyance direction 16 and the direction opposite to the conveyance direction 16 while nipping the recording paper 12.

The re-conveyance roller pair 59 is arranged for the fourth conveyance passage 69. The re-conveyance roller pair 59 is provided with a re-conveyance roller 51 and the driven roller 52 which are opposed to one another. The re-conveyance roller 51 is rotated by the driving force transmitted from the motor (not depicted). The driven roller 52 is rotated in accordance with the rotation of the re-conveyance roller 51. The re-conveyance roller pair 59 conveys the recording paper 12 in the conveyance direction 18 while nipping the recording paper 12.

Note that as for the respective rollers 60, 62, 45, 52, the driving force may be transmitted from an identical motor, or the driving force may be transmitted from different motors.

<Recording Unit 24>

As depicted in FIG. 2, the recording unit 24 is arranged between the conveyance roller pair 57 and the discharge roller pair 65 in the first conveyance passage 65. In this embodiment, the recording unit 24 records the image on the recording paper 12 conveyed along the first conveyance passage 65 in accordance with the ink-jet system. Note that the system for recording the image on the recording paper 12 by the recording unit 24 is not limited to the ink-jet system, which may be any other system including, for example, the electrophotography system.

<Route Switching Member 41>

As depicted in FIG. 2, a route switching member 41 is arranged between the discharge roller pair 58 and the reversing roller pair 56 in the first conveyance passage 65. The route switching member 41 is provided with a flap 49 and a shaft 50. The flap 49 extends to the first conveyance passage 65 from the shaft 50 supported by the first upper guide member 54. The flap 49 is pivotally supported by the shaft 50. The flap 49 is moved to swing about the center of the shaft 50 between the reversing position (position depicted by solid lines in FIG. 2) at which the first conveyance passage 65 is closed and the discharge position (position depicted by broken lines in FIG. 2) at which the recording paper 12 is permitted to pass along the first conveyance passage 65. Note that the flap 49 may be movable between the reversing position and the discharge position by any means other than the swing movement, for example, by means of the movement in the upward direction 4 and the downward direction 5.

In the ordinary state, the flap 49 is disposed at the reversing position in accordance with the self-weight. Note that the flap 49 may be urged to the reversing position, for example, by means of a spring. The flap 49 is moved pivotally about the shaft 50 from the reversing position toward the discharge position by being lifted upwardly by the recording paper 12 which is subjected to the image recording on the surface by the recording unit 24 and which is conveyed in the conveyance direction 16. After that, the flap 49 guides the recording paper 12 which is conveyed in the conveyance direction 16. Further, the flap 49 moves pivotally from the discharge position to the reversing position by means of the self-weight in accordance with the arrival of the backward end (upstream end in the conveyance direction 16) of the recording paper 12 conveyed in the conveyance direction 16 at the branching position 69A.

If the reversing roller 45 of the reversing roller pair 56 continues the rotation in the same direction as that provided therebefore in this state, then the recording paper 12 is conveyed in the conveyance direction 16, and the recording paper 12 is discharged to the discharge tray 21. On the other hand, if the rotation direction of the reversing roller 45 is switched to the opposite direction (reverse direction), the recording paper 12 enters the fourth conveyance passage 69 while using the upstream end in the conveyance direction 16 as the forward end. The recording paper 12, which has entered the fourth conveyance passage 69, is conveyed in the conveyance direction 18 along the fourth conveyance passage 69 by means of the re-conveyance roller pair 59.

After that, the recording paper 12 passes through the merging position 69B, and the recording paper 12 is conveyed in the conveyance direction 17 along the second conveyance passage 66. In other words, the second conveyance passage 66 is also the route for conveying the recording paper 12 on which the image has been recorded by the recording unit 24, the recording paper 12 having passed through the fourth conveyance passage 69. The recording paper 12, which has passed through the second conveyance passage 66, is conveyed in the conveyance direction 16 by the conveyance roller pair 57, and the recording paper 12 arrives at the recording unit 24 again. In this situation, the back surface of the recording paper 12 is opposed to the recording unit 24. The recording unit 24 records the image on the back surface of the recording paper 12. The recording paper 12, which has the image recorded on the back surface by the recording unit 24, is conveyed in the conveyance direction 16 by the discharge roller pair 58 and the reversing roller pair 56, and the recording paper 12 is discharged to the discharge tray 21.

<Cover Member 80>

As depicted in FIG. 2, the cover member 80 is supported by the casing 14 under or below the rear tray 70 at the backward surface 15 (see FIG. 1) of the casing 14. As depicted in FIG. 3, the cover member 80 is provided with the first resin member 81, the second resin member 82, and the third resin member 83.

Each of the first resin member 81, the second resin member 82, and the third resin member 83 is integrally formed with resin.

The third resin member 83 is the member which has the coefficient of friction smaller than those of the first resin member 81 and the second resin member 82. In this embodiment, the third resin member 83 is composed of polyacetal (POM), and each of the first resin member 81 and the second resin member 82 is composed of polystyrene (PS). It is a matter of course that the first resin member 81, the second resin member 82, and the third resin member 83 may be composed of any resin other than the above, provided that the magnitude correlation concerning the coefficient of friction is fulfilled as described above.

Note that in the following explanation about the respective structures of the cover member 80 (first resin member 81, second resin member 82, third resin member 83), the respective directions (upward direction 4, downward direction 5, frontward direction 6, backward direction 7, rightward direction 8, and leftward direction 9) are defined assuming that the cover member 80 is disposed at the first position as described later on (position depicted by solid lines in FIG. 2), unless otherwise stated.

<First Resin Member 81>

Figure 4:
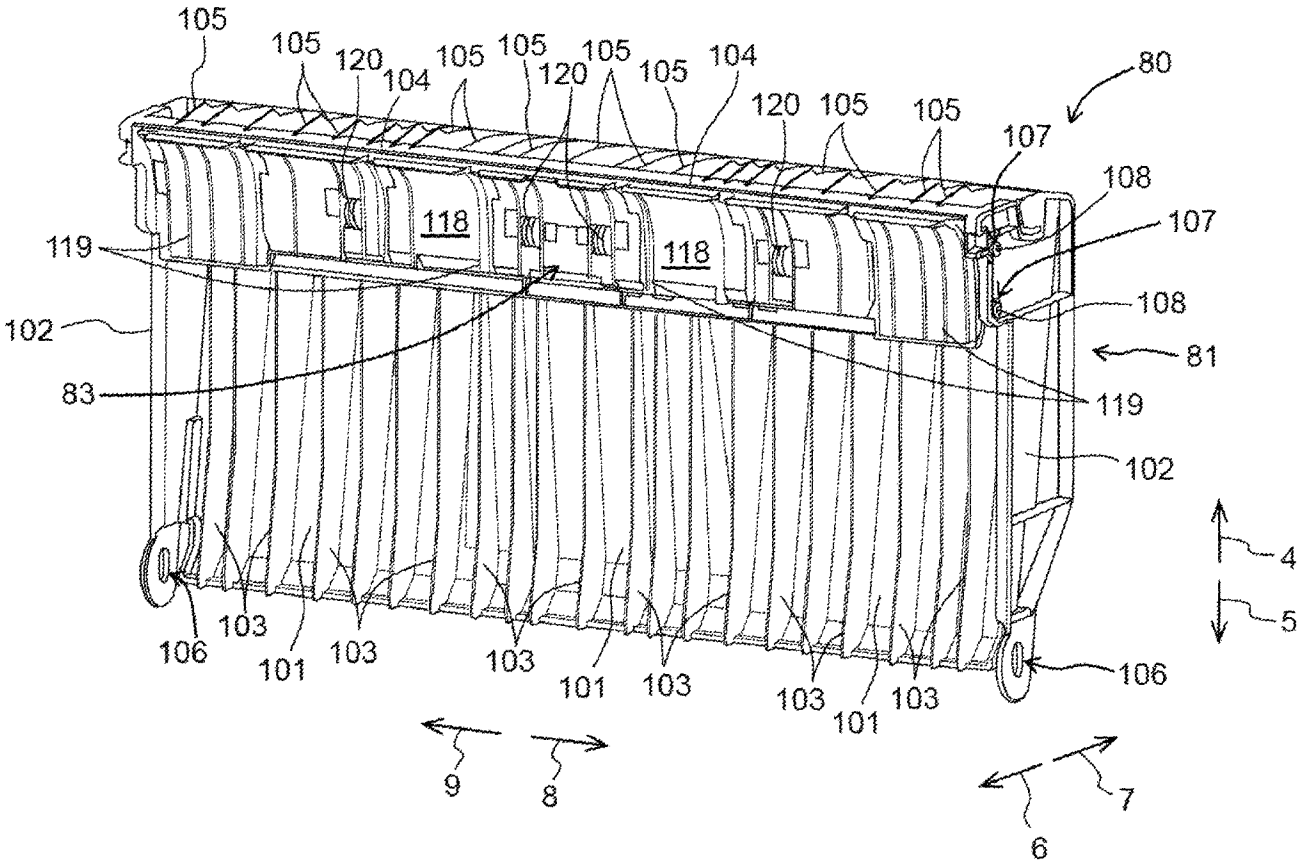
FIG. 4 depicts a perspective view illustrating the cover member.

As depicted in FIG. 4, the first resin member 81 is provided with a base portion 101 which has a generally plate-shaped form, a pair of side portions 102 which are provided at both left and right end portions of the base portion 101, a plurality of ribs 103 which protrude frontwardly from portions disposed between the pair of side portions 102 of the base portion 101, a connecting portion 104 which connects front end portions of the upper end portions of the pair of side portions 102, and a plurality of ribs 105 which connect the upper end portion of the base portion 104 and the connecting portion 104.

Openings 106 are formed at the lower end portions of the pair of side portions 102. Projections 78 (see FIG. 2), which are provided on the backward surface 15 of the casing 14 (see FIG. 1), are inserted into the openings 106. Accordingly, the cover member 80 is pivotally supported by the casing 14 about the centers of the shafts disposed at the lower end portions of the first resin member 81. Note that the shafts resides in the virtual line which passes through the centers of the projections 78.

The cover member 80 is pivotally moved to the first position depicted by solid lines in FIG. 2 and the second position depicted by broken lines in FIG. 2. The first resin member 81 is in the upstanding state at the first position. The first resin member 81 is in the state of being inclined with respect to the backward surface 15 of the casing 14 (see FIG. 1) when the cover member 80 is disposed at the second position. When the cover member 80 is disposed at the first position, the curved passage 65A and the second conveyance passage 66 are closed with respect to the outside of the casing 14. Further, when the cover member 80 is disposed at the first position, the first resin member 81 defines the curved passage 65A as described later on. On the other hand, when the cover member 80 is disposed at the second position, the curved passage 65A and the second conveyance passage 66 are exposed to the outside of the casing 14.

Figure 5:
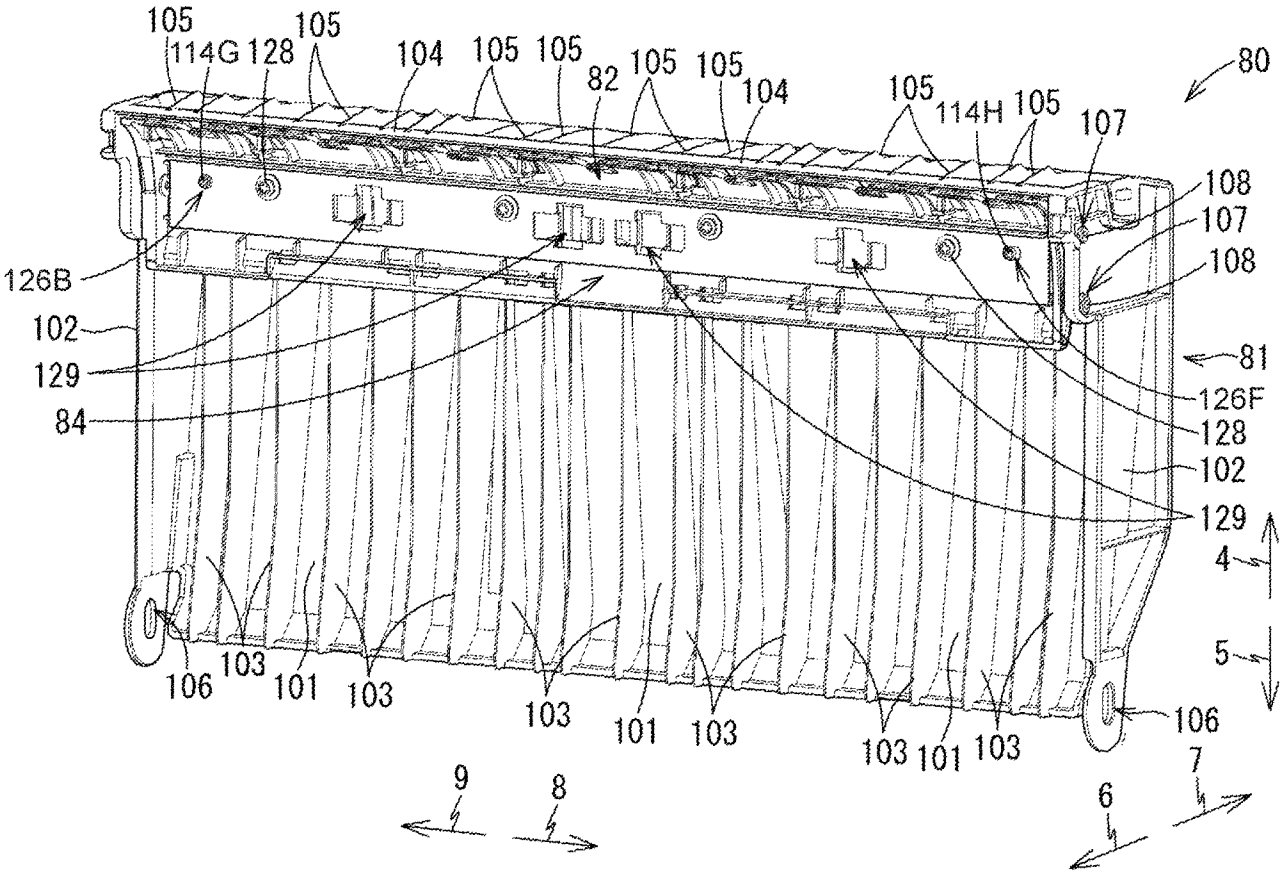
FIG. 5 depicts a perspective view illustrating the cover member from which a third resin member is removed.
Figure 9:
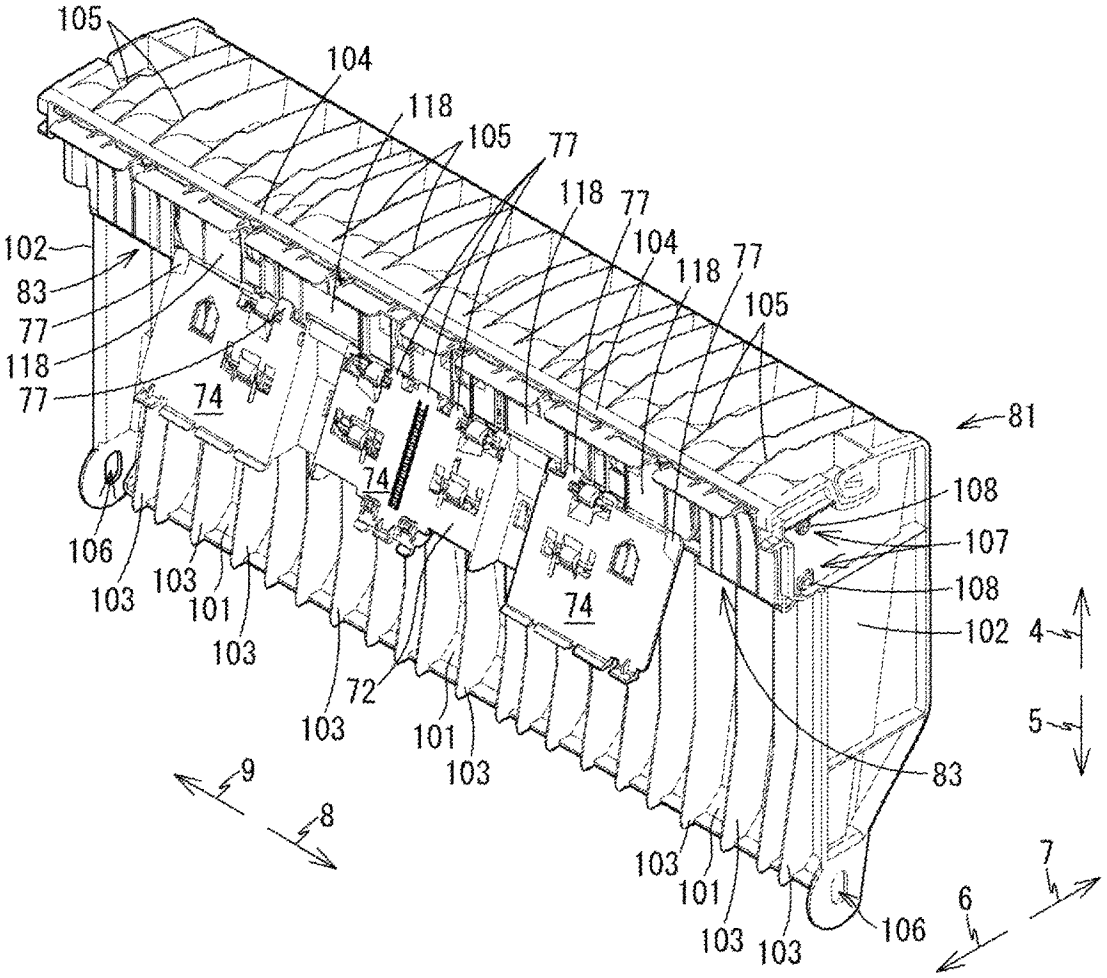
FIG. 9 depicts a perspective view illustrating the cover member and the second guide member.

Openings 107 are formed at the upper end portions and the front end portions of the pair of side portions 102. Two of the openings 107 are formed for each of the side portions 102. The two openings 107 are formed while providing the spacing distance in the upward-downward direction. Projections 108 of the second resin member 82 are inserted into the openings 107 as described later on. Note that FIGS. 4, 5, and 9 depict the state in which the projections 108 are inserted into the openings 107.

The plurality of ribs 103 are provided while providing the spacing distances in the widthwise direction. Further, the respective ribs 103 extend in the conveyance direction 16. When the cover member 80 is disposed at the first position, then the recording paper 12, which is conveyed along the curved passage 65A, abuts against the protruding forward end surfaces of the respective ribs 103, and the recording paper 12 is guided along the curved passage 65A. In other words, the virtual plane including the protruding forward end surfaces of the respective ribs 103 (example of the first guide surface) defines the curved passage 65A.

As depicted in FIG. 3, the protruding forward end surfaces of the respective ribs 103 extend in the upward direction 4 at the upstream portions in the conveyance direction 16 as viewed in a side view, and the protruding forward end surfaces of the respective ribs 103 are curved upwardly in the frontward direction at the downstream portions in the conveyance direction 16 of the plurality of ribs 103.

As depicted in FIG. 4, the plurality of ribs 105 are provided while providing the spacing distances in the widthwise direction. Further, the respective ribs 103 extend frontwardly and backwardly. When the cover member 80 is disposed at the first position, then the recording paper 12, which is conveyed along the third conveyance passage 64, abuts against the protruding forward end surfaces of the respective ribs 105, and the recording paper 12 is guided along the third conveyance passage 64. In other words, the virtual plane, which includes the protruding forward end surfaces of the respective ribs 105, defines the third conveyance passage 64.

<Second Resin Member 82>

Figure 7:
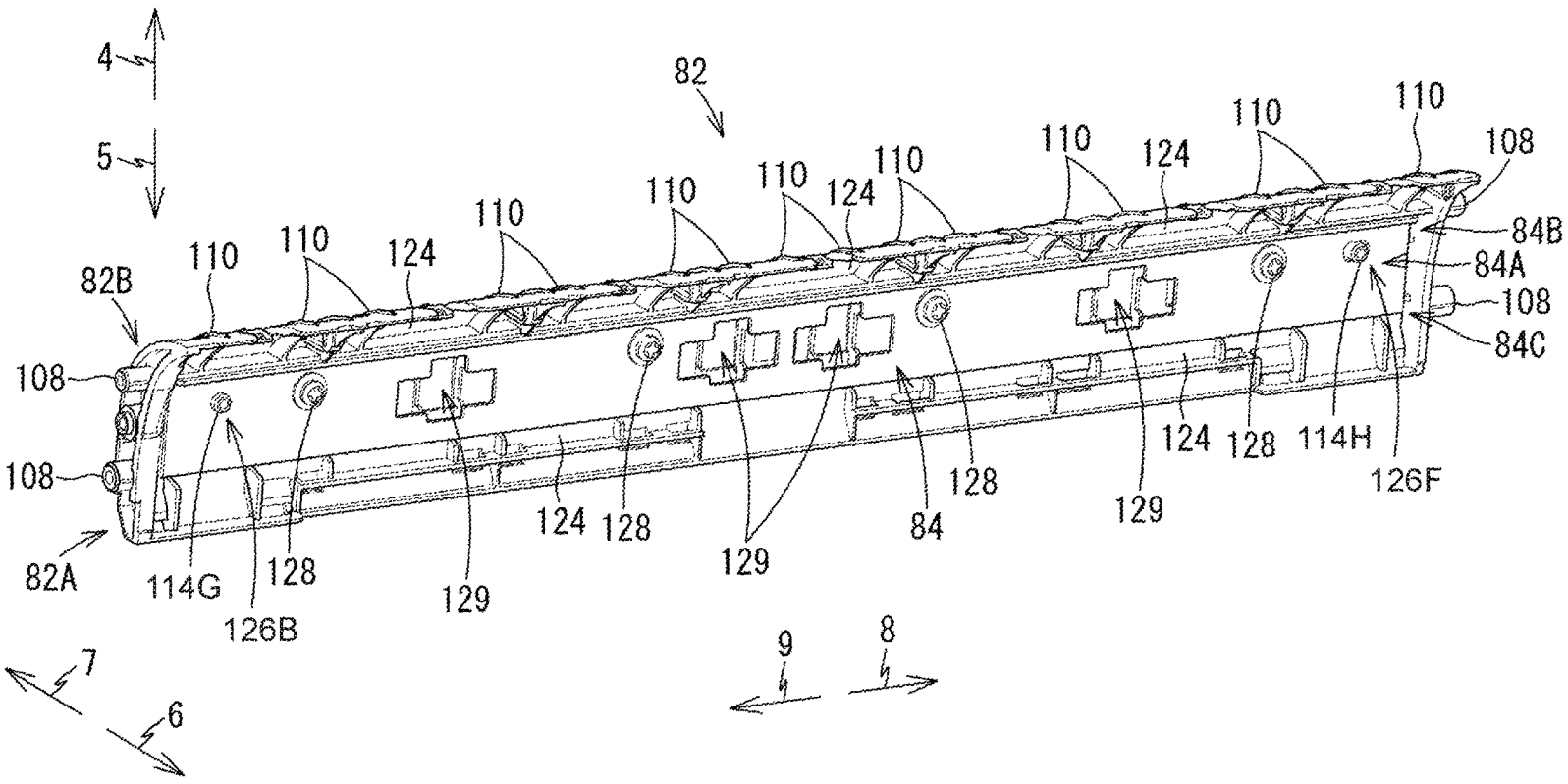
FIG. 7 depicts a perspective view illustrating the second resin member and a metal frame.
Figure 8:
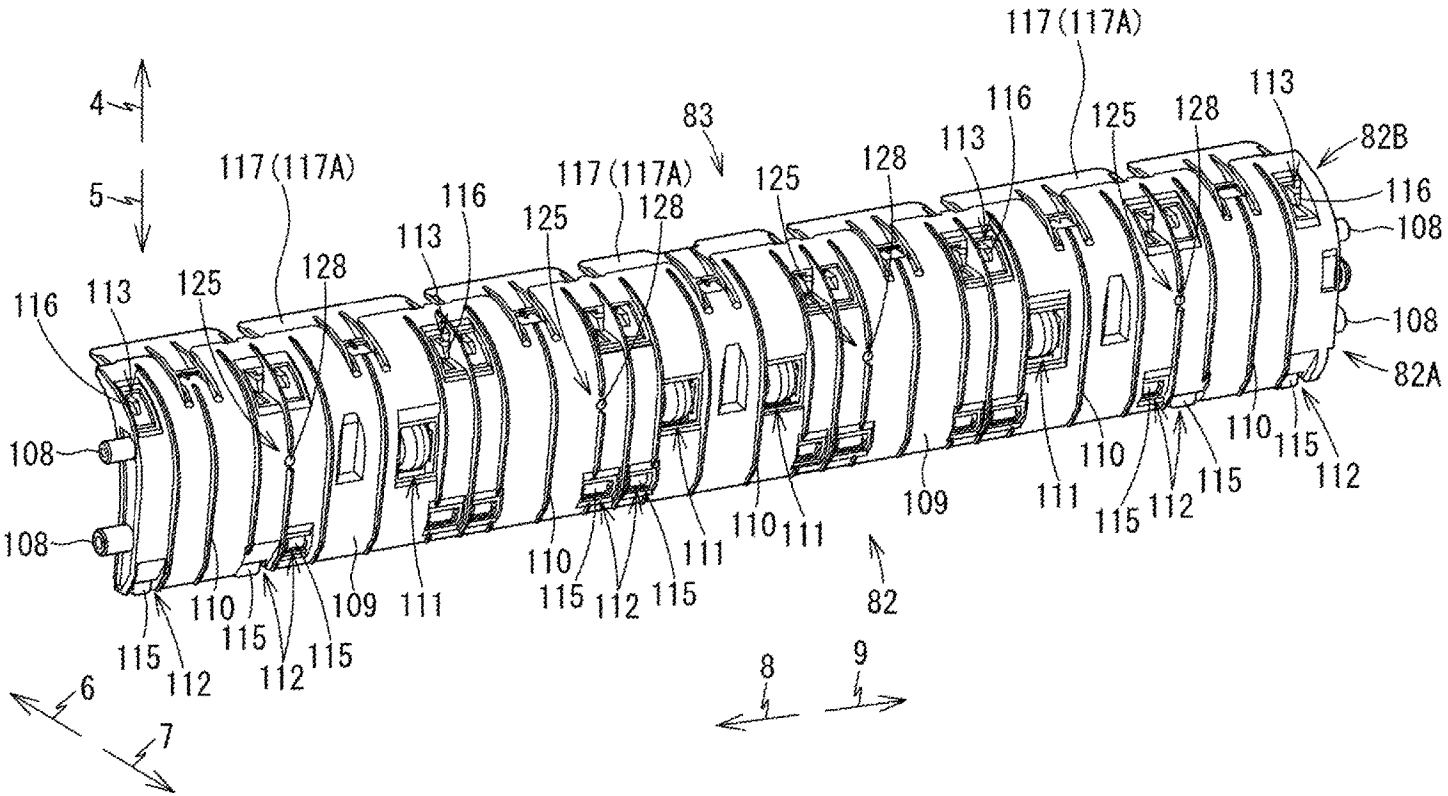
FIG. 8 depicts a perspective view illustrating the second resin member and the third resin member.

As depicted in FIGS. 7 and 8, the second resin member 82 is the member which has a generally plate-shaped form. As depicted in FIG. 5, the second resin member 82 is attached to the first resin member 81. As for the second resin member 82 in the state of being attached to the first resin member 81, the lengths in the upward direction 4 and the downward direction 5 as well as the rightward direction 8 and the leftward direction 9 are longer than the lengths in the frontward direction 6 and the backward direction 7, and the lengths in the rightward direction 8 and the leftward direction 9 are longer than the lengths in the upward direction 4 and the downward direction 5.

The projections 108 are formed at the left and right both ends of the second resin member 82. The two projections 108 protrude in the rightward direction 8 from the right end of the second resin member 82, and the two projections 108 protrude in the leftward direction 9 from the left end of the second resin member 82. The projections 108 are inserted into the openings 107 of the first resin member 81 (see FIG. 5). Accordingly, the second resin member 82 is attached to the first resin member 81. As a result, as depicted in FIG. 2, the second resin member 82 is pivotally movable integrally with the first resin member 81.

The respective projections 108 are movable in the widthwise direction with respect to the respective openings 107 of the side portions 102 of the first resin member 81 in the state in which the second resin member 82 is assembled to the first resin member 81. That is, as for the right end and the left end of the second resin member 82, the respective projections 108 are inserted into the respective openings 107 of the side portions 102 of the first resin member 81, and the forward end portions of the respective projections 108 are prevented from being disengaged in the state in which the spacing distances are provided with respect to the side portions 102 of the first resin member 81. Accordingly, the respective projections 108 are slidable in the directions opposite to the respective protruding directions in the sate of being positioned upwardly/downwardly and frontwardly/backwardly.

As depicted in FIGS. 3 and 7, the second resin member 82 is constructed by an extending portion 82A and a curved portion 82B (example of the first curved portion). The extending portion 82A constitutes the lower portion of the second resin member 82, and the extending portion 82A extends in the upward direction 4 as viewed in a side view. The curved portion 82B is continued to the upper end of the extending portion 82A. The curved portion 82B constitutes the upper portion of the second resin member 82, and the curved portion 82B is curved in the frontward direction 6 while extending in the upward direction as viewed in a side view.

As depicted in FIG. 3, the second resin member 82 is opposed to the upper portion of the first resin member 81 while providing the spacing distance in the state in which the second resin member 82 is attached to the first resin member 81. Then, as depicted in FIGS. 3 and 8, a plurality of ribs 110 are formed on a surface 109 of the second resin member 82 opposed to the first resin member 81. The plurality of ribs 110 are provided while providing the spacing distances in the widthwise direction. Further, the respective ribs 110 extend in the conveyance direction 16.

When the cover member 80 is disposed at the first position, then the recording paper 12, which is conveyed along the curved passage 65A, abuts against the protruding forward end surfaces of the respective ribs 110, and the recording paper 12 is guided along the curved passage 65A. In other words, the virtual plane (example of the second guide surface, the inner guide surface), which includes the protruding forward end surfaces of the respective ribs 110, is opposed to the ribs 103, and the virtual plane defines the curved passage 65A at the inward position as compared with the virtual plane which includes the protruding forward end surfaces of the ribs 103.

The respective ribs 110 extend in the upward direction 4 (example of the first direction) at the extending portion 82A positioned at the upstream portion in the conveyance direction 16, and the respective ribs 110 are curved in the frontward direction 6 (example of the second direction) while extending in the upward direction 4 at the curved portion 82B positioned at the downstream portion in the conveyance direction 16. Further, as described above, the ribs 103 of the first resin member 81 are also allowed to extend and curved in the same manner as the ribs 110. Accordingly, the curved passage 65A extends in the upward direction 4 at the upstream portion in the conveyance direction 16, and the curved passage 65A is curved in the frontward direction 6 while extending in the upward direction 4 at the downstream portions in the conveyance direction 16 of the plurality of ribs 103.

As depicted in FIG. 8, openings 111, 112, 113 are formed for the second resin member 82. The plurality of openings 111, 112, 113 are formed respectively.

The openings 111 are formed at the extending portion 82A. Rollers 120 are inserted into the openings 111 as described later on. The openings 112 are formed below the openings 111 of the extending portion 82A. Projections 115 of the third resin member 83 are inserted into the openings 112 as described later on. The openings 113 are formed at the curved portion 82B. Engaging portions 116 of the third resin member 83 are inserted into the openings 113 as described later on.

As depicted in FIG. 7, projections 114, which protrude frontwardly, are formed on a back surface 124 of the surface 109 of the second resin member 82. The projections 114 are inserted into through-holes 126 of the metal frame 84 as described later on. Further, as depicted in FIG. 8, through-holes 125 are formed through the surface 109. Screws 128, which are provided to fix the metal frame 84 to the second resin member 82, are screw-engaged with the through-holes 125.

<Third Resin Member 83>

As depicted in FIG. 3, the third resin member 83 is attached to the second resin member 82 at the position opposite to the first resin member 81 in relation to the second resin member 82. In other words, the second resin member 82 is interposed between the first resin member 81 and the third resin member 83 in the state in which the third resin member 83 is attached to the second resin member 82. The third resin member 83 is attached to the second resin member 82, and thus the third resin member 83 is pivotally movable integrally with the first resin member 81 and the second resin member 82.

Figure 6:
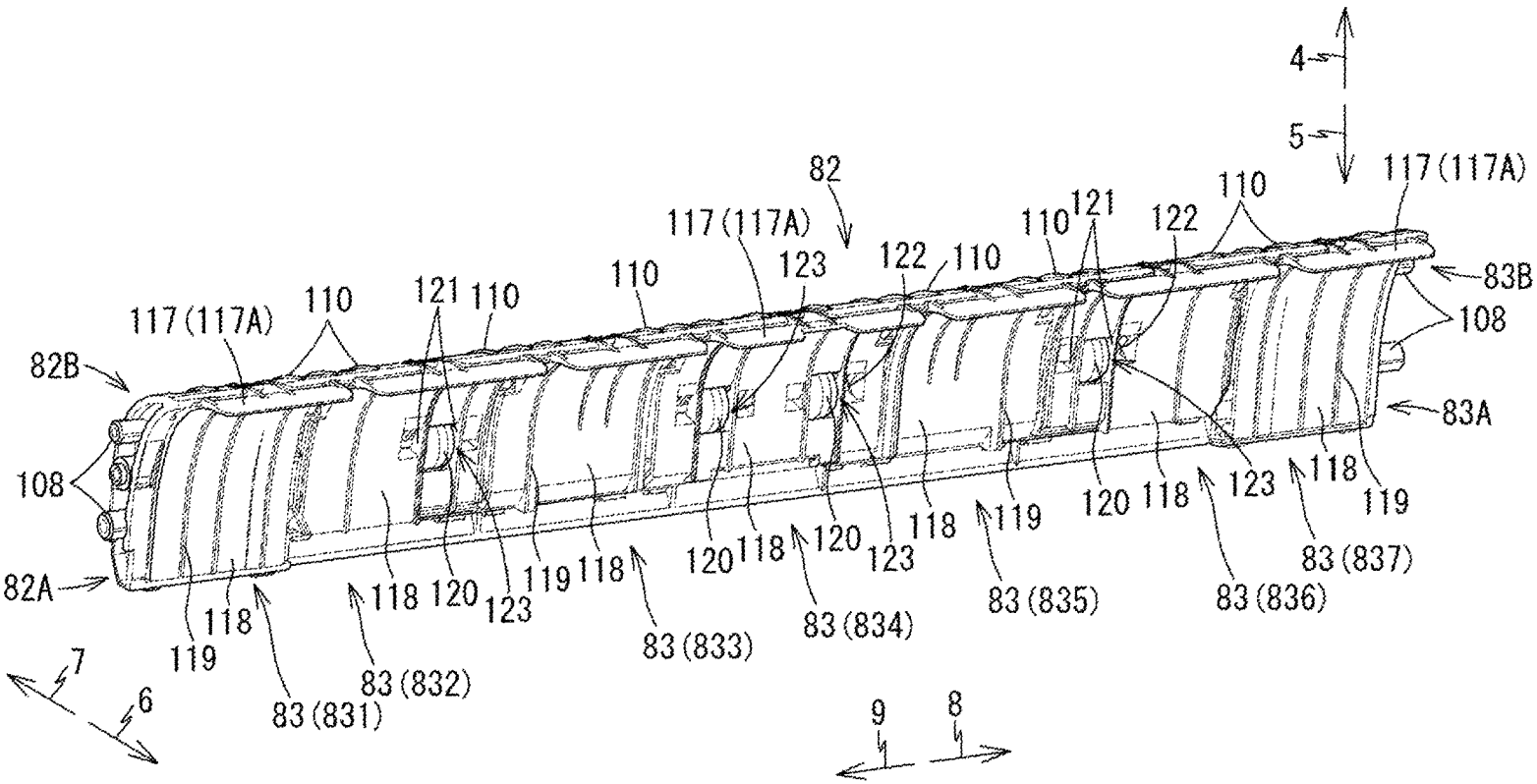
FIG. 6 depicts a perspective view illustrating a second resin member and the third resin member.

As depicted in FIG. 6, the seven third resin members 83 (831 to 837) are arranged while being aligned in the widthwise direction. Note that the number of the third resin members 83 may be any one other than seven.

As depicted in FIGS. 3 and 6, each of the third resin members 83 is a generally plate-shaped member. Each of the third resin members 83 has the lengths in the upward direction 4 and the downward direction 5 as well as the rightward direction 8 and the leftward direction 9 which are longer than the lengths in the frontward direction 6 and the backward direction 7 in the state of being attached to the second resin member 83.

As depicted in FIG. 8, each of the third resin members 83 is formed with the projections 115 and the engaging portions 116. The projections 115 protrude downwardly from the left and right both end portions of the lower end portion of each of the third resin members 83. The engaging portions 116 protrude backwardly from the left and right both end portions disposed over or above the projections 115, of the surface 117 of each of the third resin members 83 opposed to the second resin member 82. The engaging portion 116, which protrudes from the right end portion of the surface 117 of each of the third resin members 83, has the protruding forward end portion which is bent in the rightward direction 8. The engaging portion 116, which protrudes from the left end portion of the surface 117, has the protruding forward end portion which is bent in the leftward direction 9.

The projection 115 is inserted into the opening 112 of the second resin member 82. The engaging portion 116 is inserted into the opening 113 of the second resin member 82 to make the engagement in the state in which the projection 115 is inserted into the opening 112. Accordingly, such a state is given that each of the third resin members 83 is attached to the second resin member 82.

As depicted in FIGS. 3 and 6, each of the third resin members 83 is constructed by an extending portion 83A and a curved portion 83B (example of the second curved portion). The extending portion 83A constitutes the lower portion of each of the third resin members 83, and the extending portion 83A extends in the upward direction 4 as viewed in a side view. The extending portion 83A is opposed to the extending portion 82A of the second resin member 82. The curved portion 83B is continued to the upper end of the extending portion 83A. The curved portion 83B constitutes the upper portion of each of the third resin members 83, and the curved portion 83B is curved in the frontward direction 6 while extending in the upward direction 4 as viewed in a side view. The curved portion 83B is opposed to the curved portion 82B of the second resin member 82.

Figure 3A:
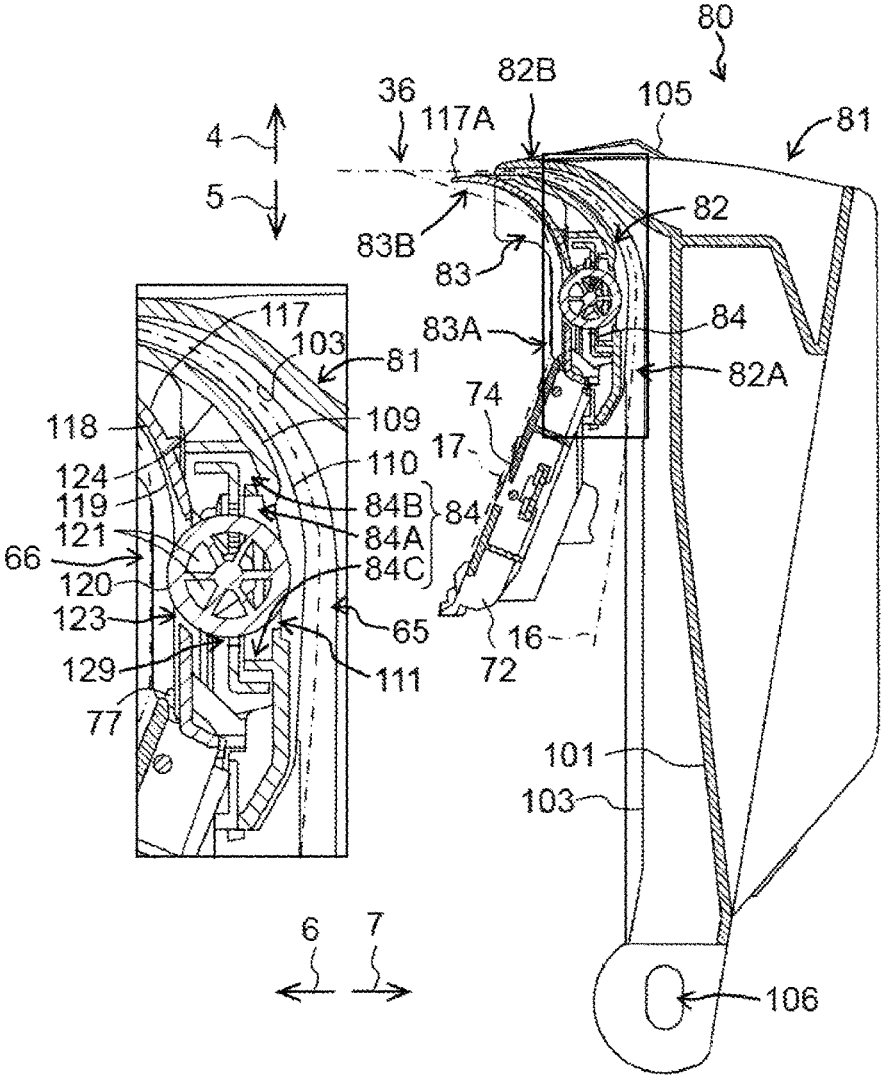
FIG. 3A depicts vertical sectional views illustrating a cover member and a second guide member.
Figure 3B:
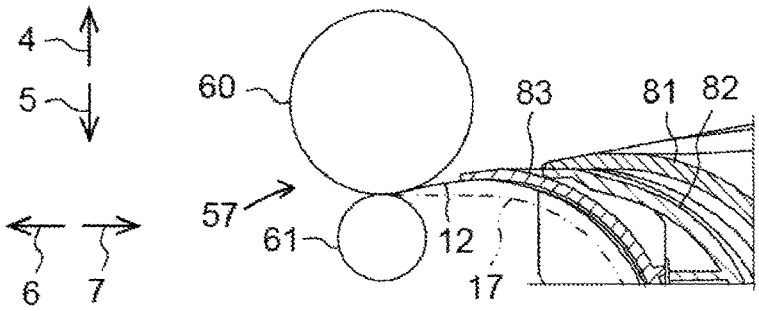
FIG. 3B illustrates an operation of the cover member.

As depicted in FIG. 3B, the downstream end in the conveyance direction 17 of the curved portion 83B of the third resin member 83 is arranged frontwardly as compared with the downstream end in the conveyance direction 17 of the curved portion 82B of the second resin member 82. The downstream end in the conveyance direction 17 of the curved portion 82B of the second resin member 82 is brought in contact with the curved portion 83B of the third resin member 83. The downstream end in the conveyance direction 17 of the curved portion 83B of the third resin member 83 is positioned in the vicinity of the conveyance roller pair 57.

As depicted in FIGS. 3A and 6, a plurality of ribs 119 are formed on a back surface 118 of the surface 117 opposed to the second resin member 82 of each of the third resin members 83 in the state in which each of the third resin members 83 is attached to the second resin member 82. The plurality of ribs 119 are provided while providing the spacing distances in the widthwise direction. Further, the respective ribs 119 extend in the conveyance direction 17.

When the cover member 80 is disposed at the first position, then the recording paper 12, which is conveyed along the second conveyance passage 66, abuts against the protruding forward end surfaces of the respective ribs 119, and the recording paper 12 is guided along the second conveyance passage 66. In other words, the virtual plane (example of the third guide surface, the outer guide surface), which includes the protruding forward end surfaces of the respective ribs 119, defines the second conveyance passage 66. Note that the recording paper 12, which is conveyed along the second conveyance passage 66, abuts against the back portion of the second upper guide member 33 which defines the second conveyance passage 66 together with the respective third resin members 83, and the recording paper 12 is guided along the second conveyance passage 66. In other words, the back portion of the second upper guide member 33 defines the second conveyance passage 66 at the position disposed inwardly from the virtual plane including the protruding forward end surfaces of the respective ribs 119.

Each of the ribs 119 extends in the upward direction 4 at the extending portion 83A positioned at the upstream portion in the conveyance direction 17, and each of the ribs 119 is curved in the frontward direction 6 while extending in the upward direction 4 at the curved portion 83B positioned at the downstream portion in the conveyance direction 17. Further, as described above, the second upper guide member 33 is curved substantially in the same direction as that of each of the third resin members 83. In other words, the second upper guide member 33 is curved substantially in the same direction as that of each of the ribs 119.

The radius of curvature of the curved portion 83B is smaller than the radius of curvature of the curved portion 82B. Accordingly, the radius of curvature of the curved portion comparted by the curved portion 83B in relation to the second conveyance passage 66 is smaller than the radius of curvature of the curved portion comparted by the curved portion 82B in relation to the first conveyance passage 65.

As depicted in FIG. 3, each of the third resin members 83 extends to the downstream position in the conveyance direction 16 as compared with the first resin member 81 and the second resin member 82. Further, as depicted in FIG. 2, the extending forward end portion of each of the third resin members 83, i.e., the downstream end portion in the conveyance direction 17 of the curved portion 83B described above is positioned in the vicinity of the nipping position of the recording paper 12 nipped by the conveyance roller pair 57.

As depicted in FIG. 3, the surface 117A (example of the fourth guide member) of the portion allowed to extend to the downstream position in the conveyance direction 16 as compared with the first resin member 81 and the second resin member 83, which is included in the surface 117 of the curved portion 83B of each of the third resin members 83, abuts, from the downward position, against the recording paper 12 conveyed along the curved passage 65A of the first conveyance passage 65, and the recording paper 12 is guided along the curved passage 65A. In other words, the surface 117A defines the curved passage 65A at the downstream position in the conveyance direction 16 as compared with the first resin member 81 and the second resin member 82.

As depicted in FIGS. 3 and 6, the third resin members 83 rotatably support the four rollers 120. In particular, as depicted in FIG. 6, the third resin member 832 rotatably supports one roller 120, the third resin member 834 rotatably supports two rollers 120, and the third resin member 836 rotatably supports one roller 120. Note that those which support the rollers 120 are not limited to the third resin members 832, 834, 836. Further, the number of the rollers 120 is not limited to four. Each of the third resin members 832, 834, 836 is provided with a pair of projections 121 which protrude backwardly from the surface 117 and which are formed while providing the spacing distances in the widthwise direction. The spacing distance between the pair of projections 121 is longer than the thickness of the roller 120 in the widthwise direction. The pair of projections 121 are formed with cutouts (not depicted), and the shaft 122 of the roller 120 is fitted into the cutouts. Accordingly, the rollers 120 are rotatably supported by the third resin members 832, 834, 836. Note that the arrangement, in which the roller 120 is rotatably supported, is not limited to the arrangement described above.

An opening 123 is formed between the pair of projections 121 of each of the third resin members 832, 834, 836. The roller 120 protrudes to the second conveyance passage 66 via the opening 123 from the back. Further, the opening 111, which is formed for the second resin member 82 described above, is opposed to the opening 123 in the frontward direction 6 and the backward direction 7. The roller 120 is inserted into the opening 111 from the front. Note that in this embodiment, the roller 120 does not protrude to the first conveyance passage 65. However, it is also allowable that the roller 120 protrudes to the first conveyance passage 65.

As depicted in FIGS. 3 and 9, when the cover member 80 is disposed at the first position, the lower end portion of the surface 118 of each of the third resin members 83 abuts against the second guide member 72 from the back. In other words, when the cover member 80 is disposed at the first position, the lower end portion of the surface 118 of each of the third resin members 83 abuts against the second guide member 72 from the side opposite to the second feed tray 22 with respect to the inclined surface 74. Further, the projection 77 of the second guide member 72 abuts against the lower end portion of the surface 118 of each of the third resin members 83. In this case, the projection 77 protrudes upwardly from the upper end of the second guide member 72, and the plurality of projections 77 are provided while providing the spacing distances in the widthwise direction.

<Metal Frame 84>

As depicted in FIG. 3, the metal frame 84 is attached to the second resin member 82 at the position disposed between the second resin member 82 and the respective third resin members 83. The metal frame 84 is attached to the second resin member 82, and thus the metal frame 84 is pivotally movable integrally with the first resin member 81, the second resin member 82, and the respective third resin members 83. The metal frame 84 is formed of metal such as stainless steel, and the metal frame 84 is constructed as one sheet of plate.

Note that in the following explanation about the metal frame 84, the respective directions (upward direction 4, downward direction 5, frontward direction 6, backward direction 7, rightward direction 8, and leftward direction 9) are defined, assuming that the cover member 80 is disposed at the first position (position depicted by solid lines in FIG. 2), unless otherwise stated.

Figures 10A, 10B, 10C:
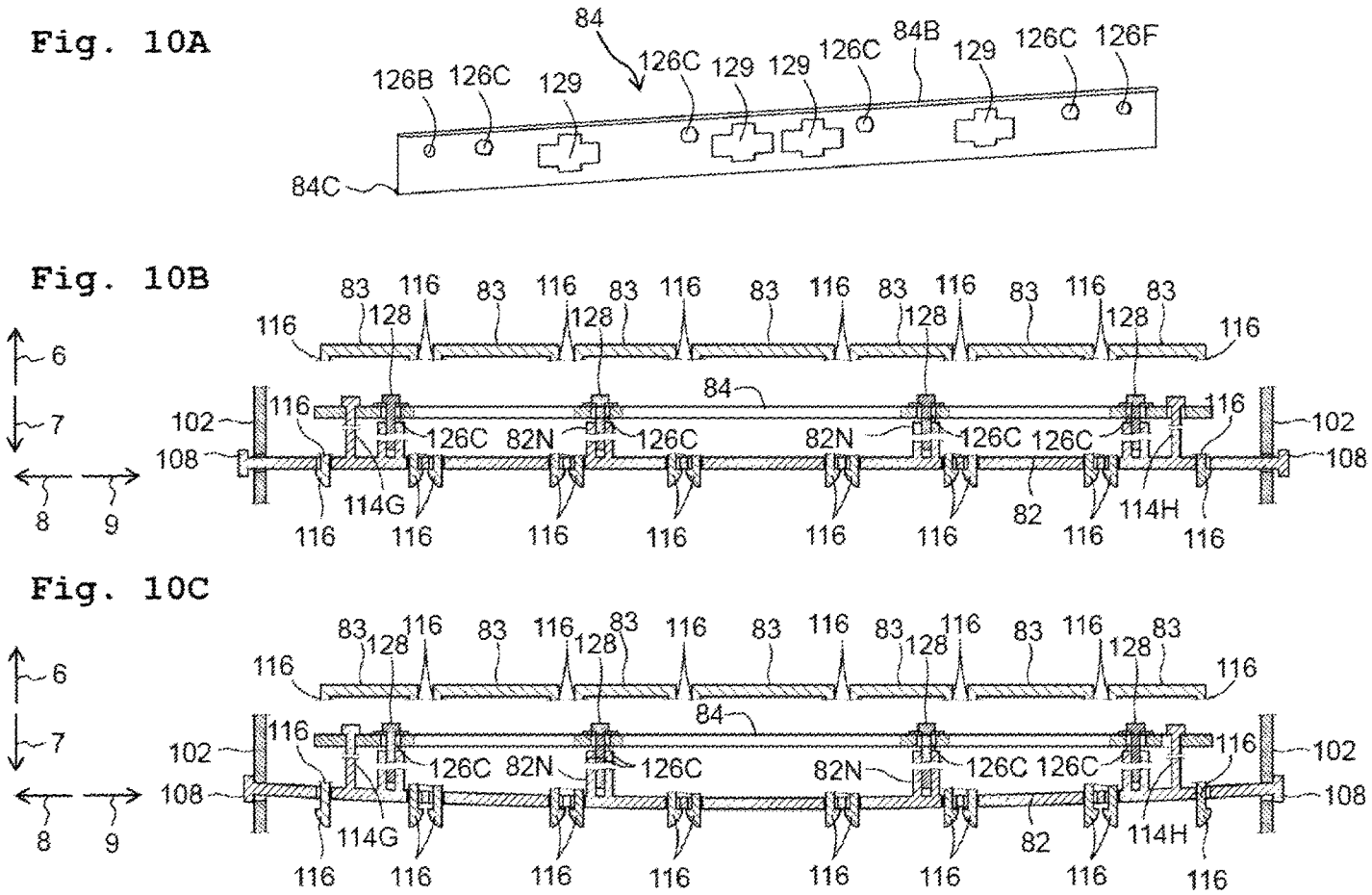
FIG. 10A depicts a perspective view illustrating a metal frame, FIG. 10B schematically explains the arrangement of a second resin member, a third resin member, and the metal frame, and FIG. 10C schematically explains a state in which the second resin member is curved.

As depicted in FIGS. 7 and 10A, the metal frame 84 is a band-shaped metal plate.

As depicted in FIGS. 3 and 7, the metal frame 84 is constructed by an extending portion 84A and two bent portions 84B, 84C.

The extending portion 84A is interposed between the extending portion 82A of the second resin member 82 and the extending portions 83A of the respective third resin members 83. In other words, the extending portion 84A is provided at the position corresponding to the extending portions 82A, 83A. The extending portion 84A extends in the upward direction 4 and the downward direction 5 as viewed in a side view.

The bent portion 84B is continued to the upper end of the extending portion 84A. The bent portion 84B is interposed between the curved portion 82B of the second resin member 82 and the bent portions 83B of the respective third resin members 83. In other words, the bent portion 84B is provided at the position corresponding to the curved portions 82B, 83B. The metal frame 84 is bent in the frontward direction 6 at the bent portion 84B as viewed in a side view.

The bent portion 84C is continued to the lower end of the extending portion 84A. The bent portion 84C is interposed between the extending portion 82A of the second resin member 82 and the extending portions 83A of the respective third resin members 83. In other words, the bent portion 84C is provided at the position corresponding to the extending portions 82A, 83A. The metal frame 84 is bent in the backward direction 7 at the bent portion 84C as viewed in a side view.

Note that the directions of the bending at the bent portions 84B, 84C of the metal frame 84 are not limited to the directions described above.

As depicted in FIG. 3A, the metal frame 84 is arranged in the widthwise direction at the position disposed oppositely to the first resin member 81 in relation to the second resin member 82 (i.e., frontwardly from the second resin member 82). The length in the widthwise direction of the metal frame 84 is shorter than the length in the widthwise direction of the second resin member 82. Further, the central portion in the widthwise direction of the metal frame 84 is arranged in a state of being coincident with the central portion in the widthwise direction of the second resin member 82. Accordingly, the both ends in the widthwise direction of the metal frame 84 are positioned while being deviated toward the center in the widthwise direction as compared with the both end portions in the widthwise direction of the second resin member 82.

As depicted in FIG. 10A, a first through-hole 126B and a second through-hole 126F are provided respectively at upper portions of the respective end portions in the widthwise direction of the metal frame 84. The first through-hole 126B, which is provided at one end portion (left end portion), is circular. The second through-hole 126F, which is provided at the other end portion (right end portion), is a long hole which extends in the widthwise direction. As depicted in FIG. 5, projections 114G, 114H (schematically depicted in FIG. 10B), which are provided in the vicinity of the both ends in the widthwise direction of the second resin member 82, are inserted into the first through-hole 126B and the second through-hole 126F. The projection 114G, which is inserted into the first through-hole 126B disposed at the left end, is in such a state that the projection 114G is not moved in the widthwise direction in the first through-hole 126B. The projection 114H, which is inserted into the second through-hole 126F, is movable in the widthwise direction.

Further, as depicted in FIG. 10A, four long holes 126C are provided between the first through-hole 126B and the second through-hole 126F at upper portions of the metal frame 84. The two long holes 126C are provided at positions disposed closely to the first through-hole 126B and the second through-hole 126F respectively. The other two long holes 126C are provided between the two long holes 126C in the state of providing approximately equal spacing distances. The respective through-holes 126C extend in the widthwise direction. As depicted in FIG. 5, a screw 128, which serves as a fastening member, is inserted into each of the through-holes 126C.

Each of the screws 128, which is inserted into the long hole 126C, is screw-tightened with a boss portion 82N (see FIG. 10B) provided for the second resin member 82 in such a state that the head provides a gap which is formed with respect to the front surface of the metal frame 84. Note that there is no limitation to the arrangement as described above. Such an arrangement is also available that the boss portion 82N is inserted into the long hole 126C, a screw is attached to the forward end of the boss portion 82N, and the metal frame 84 is prevented from being disengaged by means of the head of the screw.

The metal frame 84 is attached to the second resin member 82 by means of four screws 128. In this case, the projection 114G, which is disposed at the left end of the second resin member 82, is fixed to the first through-hole 126B of the metal frame 84. However, the four screws 128 are relatively movable in the widthwise direction with respect to the long holes 126C. Further, the second resin member 82 has the both ends in the widthwise direction which are movable toward the center in the widthwise direction with respect to the first side portion 81B and the second side portion 81C of the first resin member 81. On this account, when the pressing force, which is directed backwardly, acts, the second resin member 82 is elastically deformed to provide a curved state protruding backwardly.

As depicted in FIGS. 7 and 10A, openings 129 are formed for the metal frame 84. The openings 129 are opposed to the openings 123 of the third resin members 832, 834, 836 in the frontward direction 6 and the backward direction 7. The rollers 120, which are supported by the third resin members 832, 834, 836, are inserted into the openings 129.

<Operation of Cover Member 80 During Feeding of Recording Paper 12> In the state in which the cover member 80 is disposed at the first position, for example, the recording paper 12, which is accommodated in the second feed tray 22, is conveyed to the second conveyance passage 66 by means of the second feed unit 29.

The recording paper 12, which is conveyed through the second conveyance passage 66, is guided by the forward end surfaces of the ribs 119 of the third resin members 83, and the recording paper 12 is conveyed to the conveyance roller 60. In this situation, the conveyance roller 60 is stopped, and the forward end of the recording paper 12 abuts against the conveyance roller 60 and the pinch roller 61. Note that the state of the conveyance roller 60, which is provided when the forward end of the recording paper 12 abuts thereagainst, may be such a state that the conveyance roller 60 is rotated in the direction opposite to the rotation direction brought about when the conveyance roller 60 conveys the sheet.

When the conveyance of the recording paper 12, which is performed by the second feed unit 29, is continued in the state as described above, as depicted in FIG. 3B, the portion of the recording paper 12, which is disposed closely to the forward end, is in such a state that the portion is curved while being directed upwardly in the curved passage 66A of the second conveyance passage 66. After that, when the protruding amount, which is provided at the curved portion of the recording paper 12, is further increased, the recording paper 12 abuts against the forward end surfaces of the ribs 119 of the third resin members 83. In this situation, the recording paper 12 abuts against the third resin member 83 which is positioned at the central portion in the widthwise direction and the third resin members 83 which are positioned on the both sides in the widthwise direction with respect to the third resin member 83, depending on the size of the recording paper 12. Accordingly, the upper portions of the third resin members 83, against which the recording paper 12 abuts, are pressed backwardly.

In this situation, the pressing force, which is directed backwardly, acts on the upper portions of the third resin members 83 against which the recording paper 12 abuts, and the upper portions of the third resin members 83 are displaced while being directed backwardly. Accordingly, the engaging portion 116, which is attached to the third resin member 83, is displaced backwardly, the engaging portion 116 is separated from the circumferential edge portion of the opening 113 of the second resin member 82, and thus the engagement is released.

Further, the third resin member 83 is supported by the upper portion of the second resin member 82. Therefore, when the pressing force, which is directed backwardly, acts on the upper portion of the third resin member 83, the pressing force, which is directed backwardly, also acts on the second resin member 82. In this situation, as described above, the engaging portion 116 of the third resin member 83 is released from the engagement with the second resin member 82. Therefore, the second resin member 82 can be moved backwardly. Further, the both ends in the widthwise direction of the second resin member 82 are slidable toward the center in the widthwise direction. Further, the second resin member 82 is deformable so that the second resin member 82 protrudes backwardly with respect to the metal frame 84. According to the facts as described above, when the force, which is directed backwardly, acts on the second resin member 82, the second resin member 82 is elastically deformed to provide the curved state in which the central portion in the widthwise direction protrudes backwardly.

When the second resin member 82 is in the curved state, as depicted in FIG. 10C, the central portion in the widthwise direction of the second resin member 82 is engaged with the engaging portion 116 of the third resin member 83 having been moved backwardly. Further, the head of the screw 128 screw-tightened to the boss portion 82N of the second resin member 82 abuts against the metal frame 84.

When the pressing action in the backward direction, which is effected on the third resin member 83 by the recording paper 12, is continued in the state as described above, the force, which allows the central portion in the widthwise direction to further protrude backwardly, acts on the second resin member 82. In this situation, the force, which is directed backwardly, acts on the metal frame 84 by means of the screw 128 which is screw-tightened with the second resin member 82. The metal frame 84 has the elastic deformation ratio which is smaller than that of the second resin member 82. Therefore, owing to the metal frame 84, the second resin member 82 is suppressed from being further curved.

In this situation, the force, which is directed frontwardly, acts on the second resin member 82 by means of the metal frame 84. The force acts substantially uniformly over the entire region in the widthwise direction of the second resin member 82 having been in the curved state. The force is transmitted via the third resin member 83 to the recording paper 12 which is brought in contact with the third resin member 83.

Accordingly, the force, which is directed inwardly in relation to the curved passage 66A, acts on the recording paper 12 substantially uniformly over the entire region in the widthwise direction. As a result, the forward end of the recording paper 12 is pressed so that the forward end of the recording paper 12 abuts against the conveyance roller 60 and the pinch roller 61 over the entire region in the widthwise direction. The oblique travel state of the recording paper 12 is dissolved.

[Effect of Embodiment]

According to this embodiment, the second resin member 82 is attached to the first resin member 81, and the respective third resin members 83 are attached to the second resin member 82. Therefore, the backlashes of the second resin member 82 and the respective third resin members 83 are reduced as compared with a case in which the second resin member 82 and the respective third resin members 83 are pivotally attached to the casing 14. Accordingly, it is possible to reduce the generation of the noise which would be otherwise caused by the backlashes of the second resin member 82 and the respective third resin members 83. Further, accordingly, it is possible to stabilize the positions of the second resin member 82 and the respective third resin members 83.

Further, according to this embodiment, the third resin members 83 extend to the downstream positions in the conveyance direction 16 as compared with the first resin member 81 and the second resin member 82. Therefore, the recording paper 12, which is guided by the cover member 80 along the first conveyance passage 65 and the second conveyance passage 66, is finally guided by the third resin members 83 along the first conveyance passage 65 and the second conveyance passage 66. In this case, the member having the small coefficient of friction is used for the third resin member 83. Therefore, the recording paper 12 can be smoothly fed to the downstream position of the first conveyance passage 65 as compared with the cover member 80. In this context, if the positions of the third resin members 83 are not stable, the recording paper 12, which is fed to the downstream position of the first conveyance passage 65 as compared with the cover member 80, has the position which is not stabilized. Accordingly, in this embodiment, the metal frame 84 is attached to the second resin member 82. Accordingly, the warpage or the like of the second resin member 82 is reduced, and hence it is possible to stabilize the shape of the second resin member 82. As a result, it is possible to stabilize the positions of the second resin member 82 and the respective third resin members 83 attached to the second resin member 82.

Further, according to this embodiment, the second resin member 82 and each of the third resin members 83 are curved respectively. Therefore, it is possible to curve the first conveyance passage 65 and the second conveyance passage 66. Further, the radius of curvature of the curved portion 83B is smaller than the radius of curvature of the curved portion 82B. Therefore, the radius of curvature of the second conveyance passage 66 is smaller than the radius of curvature of the first conveyance passage 65. Then, according to this embodiment, the member, which has the small coefficient of friction, is used for each of the third resin members 83 for constructing the second conveyance passage 66 having the small radius of curvature. Accordingly, even when the radius of curvature of the second conveyance passage 66 is small, it is possible to smoothly convey the recording paper 12 along the second conveyance passage 66.

Further, according to this embodiment, the metal frame 84 is bent. Therefore, it is possible to strengthen the strength of the metal frame 84. Therefore, it is possible to further stabilize the shape of the second resin member 83.

Further, according to this embodiment, the metal frame 84 is subjected to the bending processing in conformity with the shape of the second resin member 82. Therefore, it is possible to suppress the increase in size of the second resin member 82 which would be otherwise caused by the attachment of the metal frame 84.

Further, according to this embodiment, the rollers 120, which abut against the recording paper 12, are rotated, and thus it is possible to lower the resistance against the recording paper 12 conveyed along the second conveyance passage 66. Accordingly, it is possible to smoothly convey the recording paper 12 along the second conveyance passage 66.

Further, according to this embodiment, the rollers 120 are inserted into the openings 129 formed for the metal frame 84. Therefore, it is possible to decrease the thickness of the whole of the second resin member 82, the respective third resin members 83, and the metal frame 84.

Further, according to this embodiment, the rollers 120 are inserted into the openings 111 formed for the second resin member 82. Therefore, it is possible to decrease the thickness of the whole of the second resin member 83, the respective third resin members 83, and the metal frame 84.

Further, according to this embodiment, when the recording paper 12 having a large rigidity is supported by the second feed tray 22, it is feared that the second guide member 72 may be warped on account of the inclined surface 74 pushed by the recording paper 12 having the large rigidity fed from the second feed tray 22. According to this embodiment, the respective third resin members 83 abut against the second guide member 72, and hence it is possible to reduce the warpage of the second guide member 72.

Further, according to this embodiment, the downstream end portions in the conveyance direction 17 of the respective third resin members 83 extend to the positions disposed in the vicinity of the nipping position of the recording paper 12 nipped by the conveyance roller pair 57. Therefore, it is possible to easily guide, to the nipping position, the recording paper 12 which is conveyed in the conveyance direction 16 along the first conveyance passage 65 and the recording paper 12 which is conveyed in the conveyance direction 17 along the second conveyance passage 66.

According to this embodiment, when the recording paper 12 presses the third resin members 83, then the pressing force is also applied to the second resin member 82 which supports the third resin members 83, and the second resin member 82 is elastically deformed to provide the curved state in which the second resin member 82 protrudes backwardly. In this situation, the force, which is directed inwardly in relation to the second curved passage 66A, is generated in the second resin member 82 by the metal frame 84. The force is applied to the recording paper 12 substantially uniformly over the entire region in the widthwise direction. Accordingly, it is possible to reliably dissolve the oblique travel state of the recording paper 12. Further, it is unnecessary to secure any space for providing any member to press the recording paper 12 on the side of the second resin member 82 opposite to the second conveyance passage 66. It is possible to miniaturize the entire sheet conveying apparatus.

The metal frame 84 is attached to the second resin member 82 by means of the screw 128 which is relatively movable with respect to the long hole 126 of the metal frame 84. Accordingly, the second resin member 82 is elastically deformed smoothly to provide the state in which the central portion in the widthwise direction is warped outwardly in relation to the second curved passage 66A.

The projections 108, which protrude in the widthwise direction, are provided at the both end portions of the second resin member 82. The projections 108 are inserted into the openings 107 provided for the first resin member 81, and thus the projections 108 are supported with respect to the casing 14. Accordingly, the second resin member 82 has the end portions in the widthwise direction which are reliably supported with respect to the casing 14. The central portion in the widthwise direction is elastically deformable with ease to provide the state in which the central portion in the widthwise direction is warped outwardly in relation to the second curved passage 66A.

The recording paper 12 is conveyed along the second conveyance passage 66 while using the center as the reference. Therefore, the pressing force can be allowed to act substantially uniformly over the entire region in the widthwise direction on the recording paper 12 by means of the second resin member 82 elastically deformed to provide the state in which the central portion in the widthwise direction is warped outwardly in relation to the second curved passage 66A. Accordingly, it is possible to dissolve the oblique travel state of the recording paper 12 more reliably.

The metal frame 84 is positioned between the second resin member 82 and the third resin members 83. The second resin member 82 has the virtual plane which comparts at least a part of the first conveyance passage 65, the virtual plane being disposed on the side opposite to the metal frame 84. Owing to this arrangement, the central portion in the widthwise direction of the second resin member 82 can be elastically deformed reliably to provide the state of being warped outwardly in relation to the second curved passage 66A by means of the metal frame 84.

The metal frame 84 is constructed by one sheet of plate, and the metal frame 84 has the bent portion 84A which extends in the widthwise direction 8. Therefore, the metal frame 84 is suppressed from being elastically deformed. As a result, the large force, which is directed inwardly in relation to the second curved passage 66A, can be allowed to act on the recording paper 12 by means of the second resin member 82.

The plurality of third resin members 83 are attached to the second resin member 82 in the state of being aligned in the widthwise direction. Accordingly, it is easy to attach the third resin members 83 to the second resin member 82.

The recording paper 24, on which the image has been recorded, is re-conveyed to the second conveyance passage 66 by means of the fourth conveyance passage 69. Therefore, it is possible to reliably dissolve the oblique travel state of the sheet which is re-conveyed from the fourth conveyance passage 69 to the second conveyance passage 66.

[Modified Embodiments]

In the embodiment described above, the cover member 80 is pivotally moved between the first position and the second position. However, the cover member 80 may be moved between the first position and the second position by any means other than the pivotal movement. For example, the cover member 80 may be installed to the casing 14 from the backward position in accordance with the movement in the frontward direction 6, and the cover member 80 may be removed from the casing 14 in accordance with the movement in the backward direction 7 from the installed state.

The second resin member 82 is constructed such that the second resin member 82 is supported by the aid of the first resin member 81 with respect to the casing 14. However, the second resin member 82 may be constructed such that the second resin member 82 is directly supported by the casing 14.

Further, in the embodiment described above, the ribs are formed for the first resin member 81, the second resin member 82, and the respective third resin members 83, and the recording paper 12 is guided along the protruding forward end surfaces of the ribs. However, it is also allowable that the ribs are not formed. In this case, for example, the recording paper 12 is guided along the surfaces of the respective resin members 81, 82, 83, the surfaces being directed to the respective conveyance passages.

Further, in the embodiment described above, the rollers 120 are supported by the third resin members 83. However, it is also allowable that the rollers 120 are not provided. In this case, it is also allowable that the openings for inserting the rollers 120 (openings 123 of third resin members 832, 834, 836, openings of second resin member 82, and openings 129 of metal frame 84) are not provided.

Further, in the embodiment described above, the metal frame 84 has the two bent portions 84B, 84C. However, it is also allowable that the metal frame 84 has only any one of the bent portion 84B and the bent portion 84C. Alternatively, it is also allowable that the metal frame 84 does not have the bent portions 84B, 84C.

Further, in the embodiment described above, the first conveyance passage 65 and the second conveyance passage 66 are curved. However, it is also allowable that the first conveyance passage 65 and the second conveyance passage 66 are not curved. In this case, the second resin member 82 is not provided with the curved portion 82B, and the third resin member 83 is not provided with the curved portion 83B.

Further, the fourth conveyance passage 69 may be constructed differently from the construction depicted in FIG. 2 on condition that the recording paper 12, on which the image is recorded by the recording unit 24, can be allowed to arrive at the recording unit 24 again while being inverted upside down. For example, the branching position 69A may be positioned upstream in the conveyance direction 16 from the recording unit 24, and the merging position 69B may be positioned upstream in the conveyance direction 16 from the branching position 69A.

Further, in the embodiment described above, the multifunction peripheral 10 has the two feed trays (first feed tray 20 and second feed tray 22) provided at the lower portions thereof. However, the multifunction peripheral 10 may have only the first feed tray 20 provided at the lower portion thereof. In this case, the second conveyance passage 66 is used only when the recording paper 12, on which the images are recorded on the both surfaces, is conveyed. In other words, the recording paper 12, which passes through the fourth conveyance passage 69 when the images are recorded on the both surfaces, is conveyed along the second conveyance passage 66.

Further, in the embodiment described above, the multifunction peripheral 10 has the function to record the images on the both surfaces of the recording paper 12. However, the multifunction peripheral 10 may be constructed so that the image is record on only one surface of the recording paper 12. In this case, it is also allowable that the multifunction peripheral 10 is not provided with the members for recording the images on the both surfaces (for example, second lower guide member 36, route switching member 41, reversing roller pair 45).

Further, in the embodiment described above, the multifunction peripheral 10 is provided with the rear tray 70. However, it is also allowable that the multifunction peripheral 10 is not provided with the rear tray 70.

Further, in the embodiment described above, the conveying apparatus is the apparatus which is provided to convey the recording paper 12 for recording the image by means of the printing function of the multifunction peripheral 10 as an example of the image recording apparatus. However, the conveying apparatus is not limited to the apparatus as described above. For example, the conveying apparatus may be provided for a scanner. In this case, the conveying apparatus is the apparatus which conveys the manuscript paper from which the image is to be read by the scanner.

What is claimed is:

1. A sheet conveying apparatus comprising:

a casing formed with a conveyance passage including a curved passage;

a conveyance roller positioned downstream of the curved passage in a conveyance direction of a sheet and configured to convey the sheet;

a resin member positioned outwardly in relation to the curved passage, having both end portions in a widthwise direction orthogonal to the conveyance direction which are supported by the casing, and having a central portion in the widthwise direction which is elastically deformable to be warped outwardly in relation to the curved passage;

a metal frame attached to the resin member such that a relative position of the metal frame in the widthwise direction with respect to the resin member is displaceable; and another resin member provided to be closer to the curved passage than the metal frame is to the curved passage, attached to the resin member to constitute an outer guide surface for comparing at least a part of the curved passage, and having a coefficient of friction smaller than that of the resin member at least on the outer guide surface.

2. The sheet conveying apparatus according to claim 1, wherein the metal frame has a long hole which extends in the widthwise direction, the metal frame is attached to the resin member by a fastening member inserted into the long hole; and the fastening member slides in the widthwise direction in the long hole under a condition that the resin member is elastically deformed.

3. The sheet conveying apparatus according to claim 1, wherein the resin member has projections which protrude in the widthwise direction, and the both end portions of the resin member are supported by the casing via the projections.

4. The sheet conveying apparatus according to claim 1, wherein the casing has a feed roller which feeds the sheet to the conveyance passage, and the sheet fed by the feed roller is conveyed in a state where a central position of the sheet in the widthwise direction travels along a central position of the conveyance passage in the widthwise direction.

5. The sheet conveying apparatus according to claim 1, wherein the casing further includes another conveyance passage which is formed outwardly in relation to the curved passage and along which another sheet passes toward the conveyance roller, the resin member has an outer guide surface which comparts at least a part of the another conveyance passage, and the metal frame is positioned between the resin member and the another resin member.

6. The sheet conveying apparatus according to claim 1, wherein a downstream end of the another resin member in the conveyance direction is positioned in the vicinity of the conveyance roller.

7. The sheet conveying apparatus according to claim 1, wherein the metal frame is constructed by a single plate, and has a bent portion which extends in the widthwise direction.

8. The sheet conveying apparatus according to claim 1, wherein the outer guide surface of the another resin member is formed with a first opening, and the another resin member supports a roller having a rotating shaft which extends in the widthwise direction and an outer circumferential surface protruding from the first opening.

9. The sheet conveying apparatus according to claim 8, wherein the metal frame is formed with a second opening into which a part of the roller is inserted.

10. The sheet conveying apparatus according to claim 9, wherein the resin member is formed with a third opening into which a part of the roller is inserted.

11. The sheet conveying apparatus according to claim 1, wherein the another resin member is included in a plurality of another resin members which are attached to the resin member in a state of being aligned in the widthwise direction.

12. An image recording apparatus comprising:

the sheet conveying apparatus as defined in claim 1; and a recording unit which records an image on the sheet conveyed by the conveyance roller in the casing.

13. The image recording apparatus according to claim 12, wherein the casing is provided with a re-conveyance passage through which the sheet having the image recorded by the recording unit is conveyed to the conveyance passage.

* * * * *